US010273650B1

(12) United States Patent
Villarreal

(10) Patent No.: US 10,273,650 B1
(45) Date of Patent: Apr. 30, 2019

(54) WORK VEHICLE WITH LATCHING CARRIER FOR ATTACHMENTS

(71) Applicant: Deere & Company, Moline, IL (US)

(72) Inventor: Diego Adrian Villarreal, Monterrey (MX)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 15/969,696

(22) Filed: May 2, 2018

(51) Int. Cl.
*E02F 3/36* (2006.01)
*E02F 3/34* (2006.01)

(52) U.S. Cl.
CPC ..... *E02F 3/3631* (2013.01); *E02F 3/34* (2013.01)

(58) Field of Classification Search
CPC ..... E02F 3/3631; E02F 3/3645
See application file for complete search history.

(56) References Cited

U.S. PATENT DOCUMENTS 3,985,249 A * 10/1976 Aker ..... E02F 3/3631 414/723
5,010,962 A * 4/1991 Bloom, Jr. ..... E02F 3/3604 116/281
5,078,569 A * 1/1992 Cook ..... E02F 3/3636 414/685
5,685,689 A * 11/1997 Schneider ..... E02F 3/3631 37/468
5,692,855 A * 12/1997 Burton ..... E02F 3/3631 172/272
7,001,137 B2 * 2/2006 Perrin ..... A01B 59/062 37/468
7,674,085 B2 3/2010 Byström
9,342,093 B2 * 5/2016 Villarreal ..... E02F 3/3631
9,719,227 B2 8/2017 Martin et al.
(Continued)

FOREIGN PATENT DOCUMENTS

EP 1306489 A1 * 5/2003 ..... E02F 3/3631
FR 2969674 A1 * 6/2012
(Continued)

OTHER PUBLICATIONS

Deere & Company, H-Series Front Loader photograph, undated prior art.

(Continued)

*Primary Examiner* — Gerald McClain
(74) *Attorney, Agent, or Firm* — Klintworth & Rozenblat IP LLP

(57) ABSTRACT

A carrier for coupling loader arms to an implement of a work vehicle includes a pair of brackets coupled by a cross-rod. Each bracket includes an inner wall spaced apart from an outer part. At least one of the inner walls defines a latch slot. The carrier includes a latch mechanism movable between latched and unlatched positions. The latch mechanism includes a latch plate having a retaining flange with an engagement surface, a pair of lock pins and a pair of latch receptacles associated with the brackets. When in the latched position, the latch mechanism has the lock pins received in the latch receptacles and the engagement surface disengaged from the one of the inner walls. When in the unlatched position, the latch mechanism has the retaining flange passed through the latch slot and the engagement surface engaged with the one of the inner walls.

19 Claims, 11 Drawing Sheets

(56) References Cited

U.S. PATENT DOCUMENTS

| | | | | |
|---|---|---|---|---|
| 10,106,950 | B2 * | 10/2018 | Martin | E02F 3/3631 |
| 2015/0068073 | A1 * | 3/2015 | Martin | E02F 3/3631<br>37/195 |
| 2016/0033989 | A1 * | 2/2016 | Villarreal | E02F 3/3631<br>74/470 |

FOREIGN PATENT DOCUMENTS

| | | | | | |
|---|---|---|---|---|---|
| GB | 2191169 | A | | 12/1987 | |
| JP | 55065639 | A | * | 5/1980 | E02F 3/3631 |
| JP | 57143018 | A | | 9/1982 | |
| WO | 2006036102 | A1 | | 4/2006 | |

OTHER PUBLICATIONS

Deere & Company, H340 Front Loader, The Perfect Fit for Your John Deere Tractor, 2017.
Ålö & Quicke, Q-Series Front Loader Brochure, 2018.

* cited by examiner

WORK VEHICLE WITH LATCHING CARRIER FOR ATTACHMENTS

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles, and to a latching carrier for coupling an attachment, such as a bucket, to a work vehicle.

BACKGROUND OF THE DISCLOSURE

In the agriculture, construction and forestry industries, various work vehicles, such as loaders, may be utilized in lifting and moving various materials. In certain examples, a loader may include a bucket pivotally coupled by a loader arms to the vehicle chassis. One or more hydraulic cylinders move the loader arms and/or the bucket to move the bucket between positions relative to the chassis to lift and move materials.

Generally, the bucket is reversibly or removably coupled to the loader, which enables other work implements to be used with the loader. In order to couple the bucket to the loader, in certain instances, an operator must exit the loader to attach the bucket to the loader. The trip of the operator from the loader to attach the bucket increases a cycle time of the loader, and reduces productivity. In addition, the trip is inconvenient for the operator.

SUMMARY OF THE DISCLOSURE

The disclosure provides a latching carrier for a work vehicle, such as a loader, that enables an attachment, such as a bucket, to be coupled to the work vehicle by the operator without leaving the work vehicle.

In one aspect, the disclosure provides a carrier for coupling loader arms to an implement of a work vehicle. The carrier includes a pair of brackets coupled by a cross-rod. Each bracket includes an inner wall spaced apart from an outer part, and at least one of the inner walls defines a latch slot. The carrier includes a latch mechanism movable between latched and unlatched positions. The latch mechanism includes a latch plate having a retaining flange with an engagement surface, a pair of lock pins coupled to ends of the latch plate and a pair of latch receptacles associated with the brackets and configured to receive the lock pins. When in the latched position, the latch mechanism has the lock pins received in the latch receptacles and the engagement surface of the retaining flange disengaged from the one of the inner walls of the brackets. When in the unlatched position, the latch mechanism has the retaining flange of the latch plate passed through the latch slot and the engagement surface of the retaining flange engaged with the one of the inner walls of the brackets.

Further provided is a work vehicle including a pair of loader arms configured to be coupled to an implement. The work vehicle includes a trigger plate coupled to one of the pair of loader arms, and a carrier for coupling the pair of loader arms to the implement. The carrier includes a pair of brackets coupled by a cross-rod. Each bracket includes an inner wall spaced apart from an outer part, and at least one of the inner walls defines a latch slot. The carrier includes a latch mechanism movable between latched and unlatched positions. The latch mechanism includes a latch plate having a retaining flange with an engagement surface, a pair of lock pins coupled to ends of the latch plate and a pair of latch receptacles associated with the brackets and configured to receive the lock pins. When in the latched position, the latch mechanism has the lock pins received in the latch receptacles and the engagement surface of the retaining flange disengaged from the one of the inner walls of the brackets. When in the unlatched position, the latch mechanism has the retaining flange of the latch plate passed through the latch slot and the engagement surface of the retaining flange engaged with the one of the inner walls of the brackets. The trigger plate contacts the retaining flange to move the latch mechanism from the unlatched position to the latched position.

Also provided is a work vehicle including a pair of loader arms configured to be coupled to an implement. The work vehicle includes a trigger plate coupled to one of the pair of loader arms, and a carrier for coupling the pair of loader arms to the implement. The carrier includes a pair of brackets coupled by a cross-rod each bracket including an inner wall spaced apart from an outer part, and at least one of the inner walls defining a latch slot. The carrier includes a latch mechanism movable between latched and unlatched positions. The latch mechanism includes a latch plate having a retaining flange with an engagement surface, a pair of lock pins coupled to ends of the latch plate, a spring coupled to one of the ends of the latch plate, and a pair of latch receptacles associated with the brackets and configured to receive the lock pins. The spring biases the latch mechanism in the latched position. When in the latched position, the latch mechanism has the lock pins received in the latch receptacles and the engagement surface of the retaining flange disengaged from the one of the inner walls of the brackets. When in the unlatched position, the latch mechanism has the retaining flange of the latch plate passed through the latch slot and the engagement surface of the retaining flange engaged with the one of the inner walls of the brackets. The trigger plate contacts the retaining flange to move the latch mechanism from the unlatched position to the latched position.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
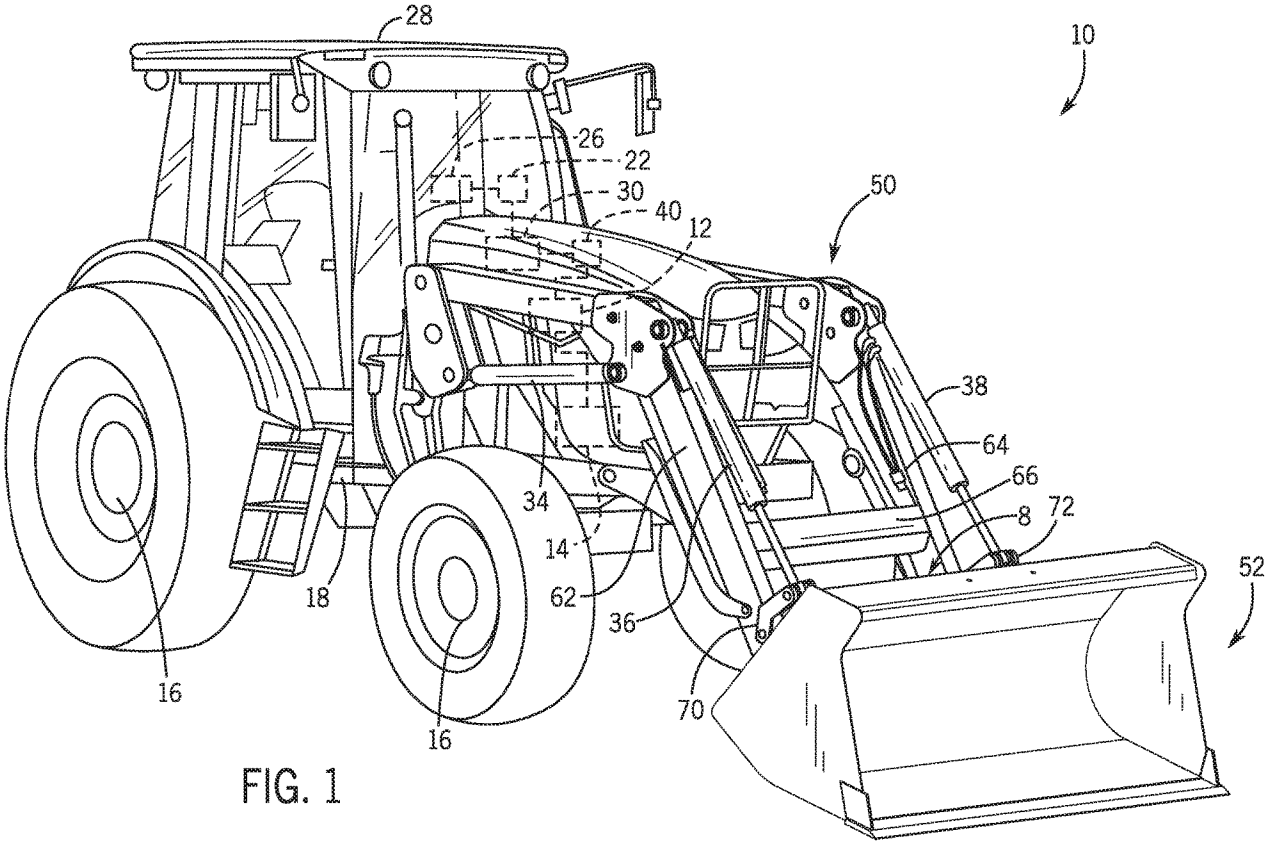
FIG. 1 is a perspective view of an example work vehicle in the form of an agricultural loader in which the disclosed latching carrier may be used to couple a bucket to the loader, and the bucket is coupled to the loader via the latching carrier in FIG. 1.

The following describes one or more example embodiments of the disclosed latching carrier, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

In certain instances, carriers for coupling work implements, such as buckets, to a work vehicle, such as a loader, require operators to make multiple trips from the cab of the work vehicle to connect the bucket to the loader. Each trip the operator makes from a cab of the loader to connect the bucket reduces cycle time and productivity of the loader, and also reduces operator satisfaction.

This disclosure provides an alternative to the carriers for coupling work implements, such as buckets, to a loader by providing a latching carrier, which enables the operator to connect the bucket without leaving the cab of the loader. In this regard, the operator controls the position of the loader boom arms from the cab to connect the bucket to the latching carrier of the loader without leaving the cab. By being able to connect the bucket without leaving the cab, cycle time and productivity are increased, along with operator satisfaction. The disclosed latching carrier is reversible or enables the bucket to be connected to the loader and disconnected from the loader multiple times.

In one example, the disclosed latching carrier includes a pair of couplers that are interconnected by a cross-rod. Each of the couplers includes a respective pair of brackets, which are spaced apart. Each of the couplers also includes a retaining pin at one end, which couples to a first mounting feature of the bucket. A latch system is coupled between the respective pairs of brackets, and includes a pair of latch receptacles, which are associated with a respective one of the couplers. Each of the latch receptacles receives a respective second mounting feature of the bucket and a lock pin, to securely couple the bucket to the latching carrier. In this example, the latch system also includes a latch plate and a pair of lock pins. One of the lock pins is coupled to one end of the latch plate and is configured to be received within a respective one of the latch receptacles and second mounting features; and another of the lock pins is coupled to an opposed end of the latch plate and is configured to be received within the other one of the latch receptacles and second mounting features when the latch system is in a first, latched position. The latch system also includes a biasing member or spring, which biases the latch system into the first, latched position.

The latch system also includes a handle, which enables an operator to move the latch system (against the force of the spring) from the first, latched position to a second, unlatched position to uncouple the bucket from the loader. In certain embodiments, the handle is integrally formed with the latch plate. In the second, unlatched position, a latch plate retaining flange of the latch plate contacts an inner surface of one interior bracket of the pair of brackets to maintain the latch system in the second, unlatched position. In order to move the latch system to the first, latched position from the second, unlatched position, a trigger plate coupled to one of the loader arms contacts the latch plate retaining flange as hydraulic cylinder(s) associated with the loader arms retracts during a roll back of the bucket. The further retraction of the hydraulic cylinder(s) results in a further movement of the bucket closer to the loader arm, which causes the trigger plate to push the latch plate through a slot defined in the interior bracket and the spring force pulls the latch plate, and thus, the latch system into the first, latched position to couple the bucket to the loader.

Figure 2:
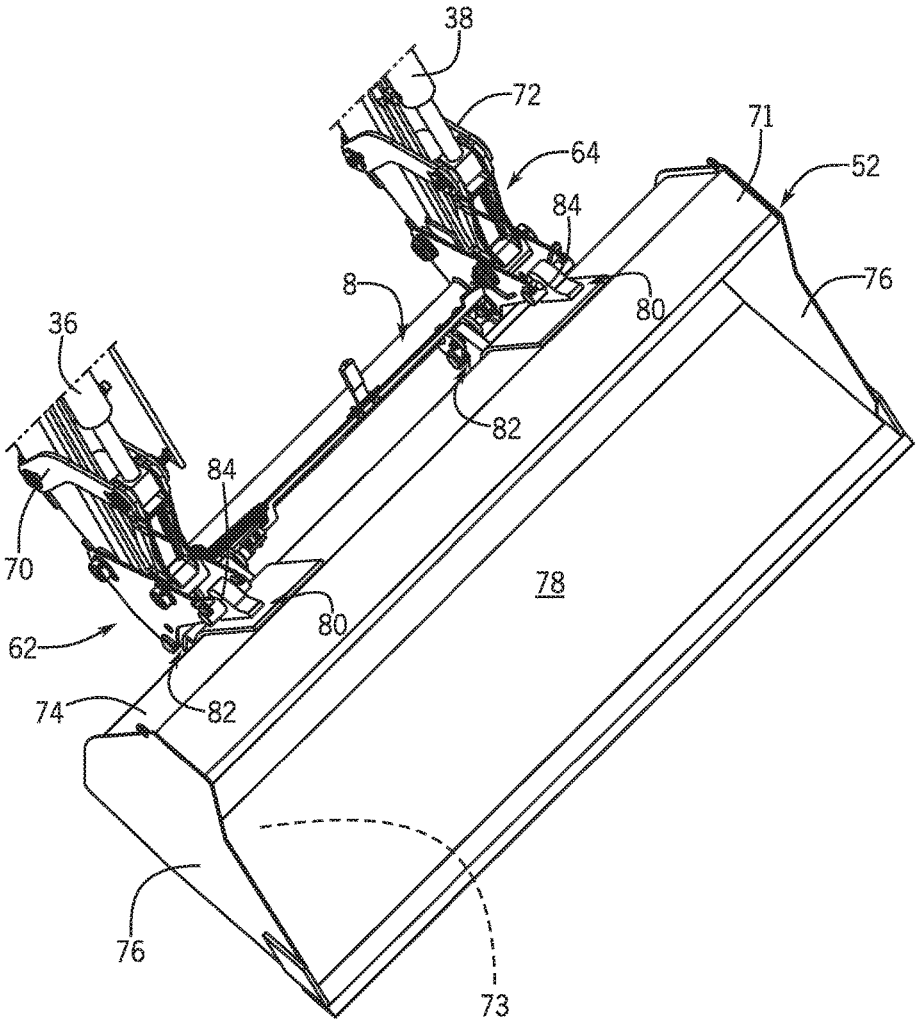
FIG. 2 is a detail perspective view of the bucket coupled to the loader of FIG. 1 via the latching carrier.

The following describes an example latching carrier for coupling an attachment, such as a bucket, to a work vehicle. The latching carrier may be utilized with various machines or work vehicles, including tractors and other machines for lifting and moving various materials in the agricultural and construction industries. Referring to FIGS. 1 and 2, in some embodiments, a latching carrier 8 may be used with an agricultural loader 10. It will be understood that the configuration of the loader 10 is presented as an example only. In this regard, the disclosed a latching carrier 8 may be implemented with a front loader removably coupled to a work vehicle, such as a tractor. Other work vehicles, such as dedicated wheel loaders used in the construction industry, may benefit from the disclosed latching carrier 8 as well.

Generally, the loader 10 includes a source of propulsion, such as an engine 12 that supplies power to a transmission 14. In one example, the engine 12 is an internal combustion engine, such as a diesel engine, that is controlled by an engine control module. The transmission 14 transfers power from the engine 12 to a suitable driveline coupled to one or more driven wheels 16 of the loader 10 to enable the loader 10 to move. The engine 12, the transmission 14 and the rest of the driveline are supported by a vehicle chassis 18, which is supported off the ground by the wheels 16. As is known to one skilled in the art, the transmission 14 can include a suitable gear transmission, which can be operated in a variety of ranges containing one or more gears, including, but not limited to a park range, a neutral range, a reverse range, a drive range, a low range, a high range, etc. The transmission 14 may be controlled by a transmission control module, which is, along with the engine control module, in communication with a master controller 22 (or group of controllers).

The controller 22 may control various aspects of the operation of the loader 10 and may be configured as a computing device with associated processor devices and memory architectures, as a hard-wired computing circuit (or circuits), as a programmable circuit, as a hydraulic, electrical or electro-hydraulic controller, or otherwise. As such, the controller 22 may be configured to execute various computational and control functionality with respect to the loader 10 (or other machinery). In some embodiments, the controller 22 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 22 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 22 may be in electronic, hydraulic, mechanical, or other communication with various other systems or devices of the loader 10 (or other machinery). For example, the controller 22 may be in electronic or hydraulic communication with various actuators, sensors, and other devices within (or outside of) the loader 10, including various devices associated with a hydraulic system. The controller 22 may communicate with other systems or devices (including other controllers) in various known ways, including via a CAN bus (not shown) of the loader 10, via wireless or hydraulic communication means, or otherwise. An example location for the controller 22 is depicted in FIG. 1. It will be understood, however, that other locations are possible including other locations on the loader 10, or various remote locations. In some embodiments, the controller 22 may be configured to receive input commands and to interface with an operator via a human-machine interface 26, which may be disposed inside a cab 28 of the loader 10 for easy access by the operator. The human-machine interface 26 may be configured in a variety of ways and may include one or more joysticks, various switches or levers, one or more buttons, a touchscreen interface that may be overlaid on a display, a keyboard, a speaker, a microphone associated with a speech recognition system, or various other human-machine interface devices.

The loader 10 also has a hydraulic system that includes one or more pumps and accumulators (designated generally by reference number 30), which may be driven by the engine 12 of the loader 10. Flow from the pumps 30 may be routed through various control valves and various conduits (e.g., flexible hoses) to drive various hydraulic cylinders, such as hydraulic cylinders 34, 36, 38, shown in FIG. 1. Flow from the pumps (and accumulators) 30 may also power various other components of the loader 10. The flow from the pumps 30 may be controlled in various ways (e.g., through control of various electro-hydraulic control valves 40) to cause movement of the hydraulic cylinders 34, 36, 38, and thus, a work implement, such as a bucket 52, relative to the loader 10. In this way, for example, movement of the bucket 52 between various positions relative to the chassis 18 of the loader 10 may be implemented by various control signals to the pumps 30, control valves 40, and so on.

In the embodiment depicted, the bucket 52 is pivotally mounted to a boom assembly 60 via the latching carrier 8. In this example, the boom assembly 60 includes a first loader arm 62 and a second loader arm 64, which are interconnected via a cross-beam 66 to operate in parallel. The loader arms 62, 64 are each coupled to the chassis 18, directly or via another frame portion of the loader 10, at one end, and are coupled at an opposite end to the bucket 52 via the latching carrier 8 (FIG. 2), which is pivoted via first and second (left and right) pivot linkages 70, 72. The pivot linkages 70, 72 enable pivotal movement of the bucket 52 upon actuation of the hydraulic cylinders 36, 38.

The hydraulic cylinders may be actuated to raise and lower the boom assembly 60 relative to the loader 10. In the illustrated example, the boom assembly 60 includes two hydraulic cylinders, namely the hydraulic cylinder 34 coupled between the chassis 18 and the first loader arm 62 and a corresponding cylinder on the opposite side of the loader (not shown) coupled between the chassis 18 and the second loader arm 64. It should be noted that the loader 10 may have any number of hydraulic cylinders, such as one, three, etc. Each of the hydraulic cylinders 34 includes an end coupled to the chassis 18 (e.g., via a coupling pin) and an end mounted to the respective one of the first loader arm 62 and the second loader arm 64 (e.g., via another pin). Upon activation of the hydraulic cylinders 34, the boom assembly 60 may be moved between various positions to elevate the boom assembly 60, and thus the bucket 52, relative to the chassis 18 of the loader 10.

One or more hydraulic cylinders 36 are mounted to the first loader arm 62 and the first pivot linkage 70, and one or more hydraulic cylinders 38 are mounted to the second loader arm 64 and the second pivot linkage 72. In the illustrated example, the loader 10 includes a single hydraulic cylinder 36, 38 associated with a respective one of the first loader arm 62 and the second loader arm 64, respectively. Each of the hydraulic cylinders 36, 38 includes an end mounted to the respective one of the first loader arm 62 and the second loader arm 64 (via another pin) and an end mounted to the respective one of the first pivot linkage 70 and the second pivot linkage 72 (via another pin). Upon activation of the hydraulic cylinders 36, 38, the bucket 52 may be moved between various positions, namely to pivot the latching carrier 8 (FIG. 2), and thereby the bucket 52, relative to the boom assembly 60.

Thus, in the embodiment depicted, the bucket 52 is pivotable about the latching carrier 8 (FIG. 2) of the boom assembly 60 by the hydraulic cylinders 36, 38. As noted, in some embodiments, a different number or configuration of hydraulic cylinders or other actuators may be used. Thus, it will be understood that the configuration of the hydraulic system and the boom assembly 60 is presented as an example only. In this regard, in other contexts, a hoist boom (e.g. the boom assembly 60) may be generally viewed as a boom that is pivotally attached to a vehicle frame, and that is also pivotally attached to an end effector (e.g., the bucket 52). Similarly, the latching carrier 8 (FIG. 2) may be generally viewed as a component effecting pivotal attachment of a bucket (e.g. the bucket 52) to a vehicle frame. In this light, a tilt actuator (e.g., the hydraulic cylinders 36, 38) may be generally viewed as an actuator for pivoting a receptacle with respect to a hoist boom, and the hoist actuator (e.g. the hydraulic cylinders 34) may be generally viewed as an actuator for pivoting a hoist boom with respect to a vehicle frame.

In certain applications, sensors (e.g., pressure, flow or other sensors) may be provided to observe various conditions associated with the loader 10. For example, the sensors may include one or more pressure sensors that observe a pressure within the hydraulic circuit, such as a pressure associated with at least one of the pumps 30, the control valves 40 and/or one or more hydraulic cylinders 34, 36, 38 to observe a pressure within the hydraulic cylinders and generate sensor signals based thereon. In some cases, various sensors may be disposed on or near the latching carrier 8 (FIG. 2) and/or the bucket 52. For example, sensors (e.g. inertial measurement sensors) may be coupled on or near the bucket 52 to observe or measure parameters including the acceleration of the boom assembly 60 and/or the bucket 52 and generate sensor signals, which may indicate if the boom assembly 60 and/or the bucket 52 is accelerating or decelerating. In some embodiments, various sensors (e.g., angular position sensors) may be configured to detect the angular orientation of the bucket 52 relative to the boom assembly 60, or to detect the angular orientation of the boom assembly relative to the chassis 18, and various other indicators of the current orientation or position of the bucket 52. For example, rotary angular position sensors may be used or linear position or displacement sensors may be used to determine the length of the hydraulic cylinders 34, 36, 38 relative to the boom assembly 60.

The bucket 52 generally defines a receptacle for carrying various materials, such as dirt, rocks, wet dirt, sand, hay, etc. In one example, the bucket 52 may receive about two cubic yards of material to over about five cubic yards of material. The bucket 52 is movable upon actuation of the hydraulic cylinders 36, 38 between a level position, a roll-back position and a dump position, along with various positions in between. In the level position, the bucket 52 can receive various materials. In the roll-back position, the bucket 52 is pivoted upward relative to the earth's surface or ground by the actuation of the hydraulic cylinders 36, 38 such that the bucket 52 may be loaded with and retain the various materials. In the dump position, the bucket 52 is pivoted downward relative to the earth's surface or ground by the actuation of the hydraulic cylinders 36, 38 such that the various materials may fall from the bucket 52 to substantially empty the bucket 52.

Figure 3:
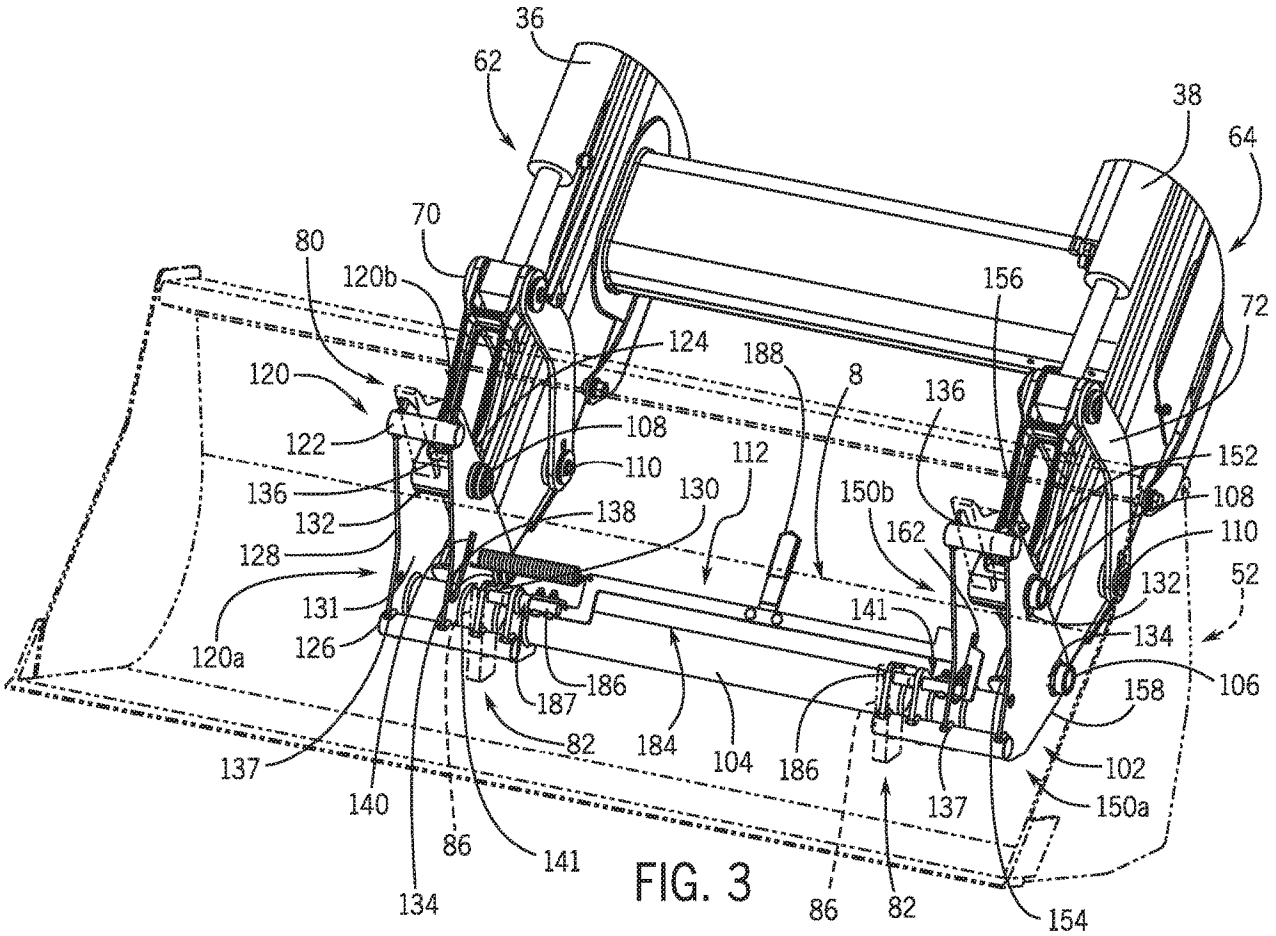
FIG. 3 is a detail perspective view of the latching carrier of the loader of FIG. 1, with the bucket shown in phantom and a latch system of the latching carrier in a first, latched position to couple the bucket to the loader.

In one example, the bucket 52 includes various mounting features for coupling the bucket 52 to the latching carrier 8. In this example, the bucket 52 has a top wall 71 opposite a bottom wall 73, with a rear wall 74 that interconnects the top wall 71 to the bottom wall 73. A pair of lateral walls 76 cooperates with the top wall 71, the bottom wall 73 and the rear wall 74 to form a receptacle 78 that receives the various materials. In this example, the bucket 52 includes a first pair of mounting features or hooks 80 coupled to the rear wall 74 proximate to the top wall 71, and a second pair of mounting features or pin receiving flanges 82 coupled to the rear wall 74 proximate the bottom wall 73. Each of the hooks 80 and the pin receiving flanges 82 are configured to be coupled to the latching carrier 8 to securely couple the bucket 52 to the loader 10 (FIG. 1). Generally, one of the hooks 80 and one of the pin receiving flanges 82 is coupled to a right side of the bucket 52 for coupling to the latching carrier 8, and thus, the first loader arm 62; and one of the hooks 80 and one of the pin receiving flanges 82 is coupled to a left side of the bucket 52 for coupling to the latching carrier 8, and thus, the second loader arm 64. Each of the hooks 80 define an opening 84, which is received onto a portion of the latching carrier 8. With reference to FIG. 3, each of the pin receiving flanges 82 define a throughbore 86, which receives a portion of the latching carrier 8 to couple the bucket 52 to the latching carrier 8.

The latching carrier 8 reversibly or removably couples the bucket 52 (FIG. 2) to the loader 10 (FIG. 1). The latching carrier 8 includes first and second (left and right) couplers 100, 102, connected by a cross-rod 104, that mount to the distal ends of the respective loader arms 62, 64 via coupling pins 106. Additional pins 108, 110 pivotally couple the pivot linkages 70, 72 between the loader arms 62, 64 and the respective first and second couplers 100, 102. As will be discussed, the latching carrier 8 also includes a latch mechanism or latch system 112, which secures the bucket 52 to the latching carrier 8, and thus, the loader arms 62, 64.

The first coupler 100 includes a pair of brackets 120 and a hook retaining pin 122. Each bracket of the pair of brackets 120 is composed of a metal or metal alloy, such as steel, and is stamped, cast, forged, etc. In this example, each of the pair of brackets 120 has a first side 124 opposite a second side 126, and a third side 128 opposite a fourth side 130. The third side 128 and the fourth side 130 interconnect the first side 124 and the second side 126. Generally, one of the brackets 120 is an exterior bracket 120*a* and the other of the brackets 120 is an interior bracket 120*b*. The exterior bracket 120*a* is spaced apart from the interior bracket 120*b* to define a channel 131 that enables the pivot linkage 70 and an end of the first loader arm 62 to be positioned between the pair of brackets 120. Each of the pair of brackets 120 include a first pin bore 132, a second pin bore 134, a retaining recess 136 and a support recess 137.

The first pin bore 132 is defined through each of the brackets 120 at or proximate the first side 124. The first pin bore 132 of each of the brackets 120 is coaxially aligned to receive the pin 108 to couple the pivot linkage 70 to the first coupler 100. The second pin bore 134 is defined through each of the brackets 120 at or proximate the first side 124 and near the fourth side 130. The second pin bore 134 of each of the brackets 120 is coaxially aligned to receive the coupling pin 106 to couple the first loader arm 62 to the first coupler 100. The retaining recess 126 is defined at the third side 128 proximate the first side 124. The retaining recess 126 is substantially C-shaped, and the retaining recess 124 of each of the brackets 120 receives the hook retaining pin 122. The support recess 137 is defined at the third side 128 proximate the second side 126. The support recess 137 is substantially C-shaped, and the support recess 137 of each of the brackets 120 receives a portion of the latch system 112.

Figure 4:
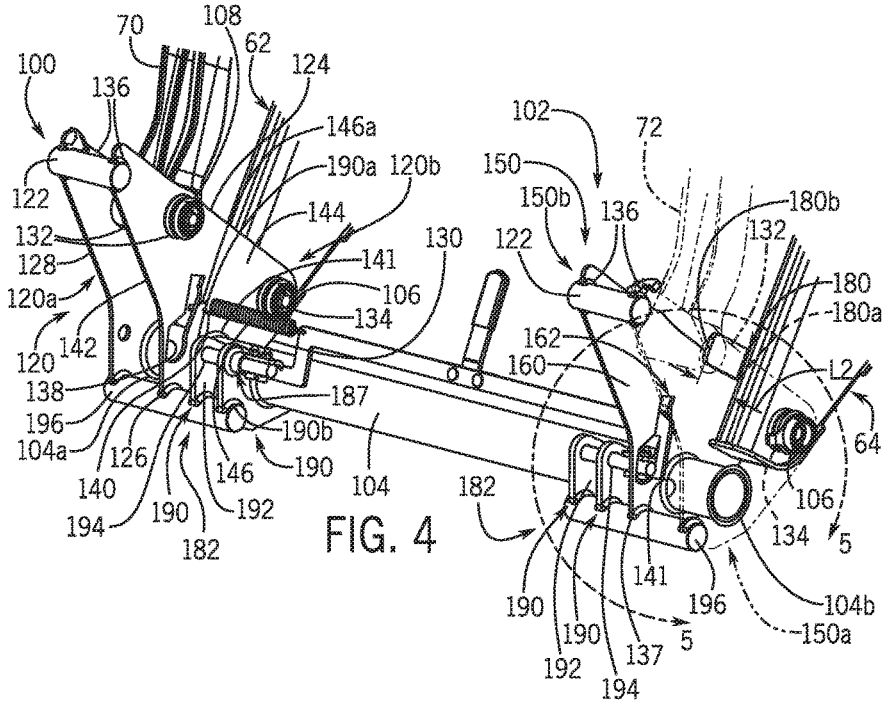
FIG. 4 is a detail perspective view of the latch system of the latching carrier of the loader in the first, latched position.

In one example, the interior bracket 120*b* includes a slot 138, a spring retainer 140 and a cross-rod bore 141. With reference to FIG. 4, the slot 138 is defined through a first surface 142 and an opposite second surface 144 of the interior bracket 120*b*. The first surface 142 is an inner wall of the interior bracket 120*b* and faces an outer part or the exterior bracket 120*a*. The slot 138 provides clearance for a portion of the latch system 112, such as a biasing member or spring 146 of the latch system 112. In one example, the spring retainer 140 is in communication with the slot 128. In this example, the spring retainer 140 is a bore, which receives an end 146*a* of the spring 146 of the latch system 112. Generally, the end 146*a* is at least partially coiled or looped, and is hooked or coupled through the spring retainer 140 and the slot 138 to couple the spring 146 to the interior bracket 120*b*. The cross-rod bore 141 is defined through the first surface 142 and the second surface 144, and is substantially circular. The cross-rod bore 141 receives the cross-rod 104 therethrough, and in one example, the cross-rod 104 may be fixedly coupled, via welding, for example, to the cross-rod bore 141.

The hook retaining pin 122 is fixedly coupled to the retaining recesses 124 of the brackets 120. In one example, the hook retaining pin 122 is welded to each of the brackets 120. The hook retaining pin 122 is composed of a metal or a metal alloy, and is stamped, cast, extruded, machined, etc. The hook retaining pin 122 is cylindrical, and is sized to be received within the opening 84 of the hook 80 of the bucket 52.

The second coupler 102 includes a pair of second brackets 150 and the hook retaining pin 122. Each bracket of the pair of second brackets 150 is composed of a metal or metal alloy, such as steel, and is stamped, cast, forged, etc. In this example, each of the pair of second brackets 150 has a first side 152 opposite a second side 154, and a third side 156 opposite a fourth side 158. The third side 156 and the fourth side 158 interconnect the first side 152 and the second side 154. Generally, one of the second brackets 150 is an exterior bracket 150*a* and the other of the second brackets 150 is an interior bracket 150*b*. The exterior bracket 150*a* is spaced apart from the interior bracket 150*b* to define a channel 160 that enables the pivot linkage 72 and an end of the second loader arm 64 to be positioned between the pair of second brackets 150. Each of the pair of second brackets 150 include the first pin bore 132, the second pin bore 134, the retaining recess 136 and the support recess 137. The hook retaining pin 122 is fixedly coupled to the retaining recesses 136 of the second brackets 150, via welding, for example.

The first pin bore 132 is defined through each of the brackets 120 at or proximate the first side 152. The first pin bore 132 of each of the brackets 120 is coaxially aligned to receive the pin 108 to couple the pivot linkage 72 to the second coupler 102. The second pin bore 134 is defined through each of the second brackets 150 at or proximate the first side 150 and near the fourth side 158. The second pin bore 134 of each of the second brackets 150 is coaxially aligned to receive the coupling pin 106 to couple the second loader arm 64 to the second coupler 102. The retaining recess 126 is defined at the third side 156 proximate the first side 150 and receives the hook retaining pin 122. The support recess 137 is defined at the third side 156 proximate the second side 152, and receives a portion of the latch system 112.

Figure 5:
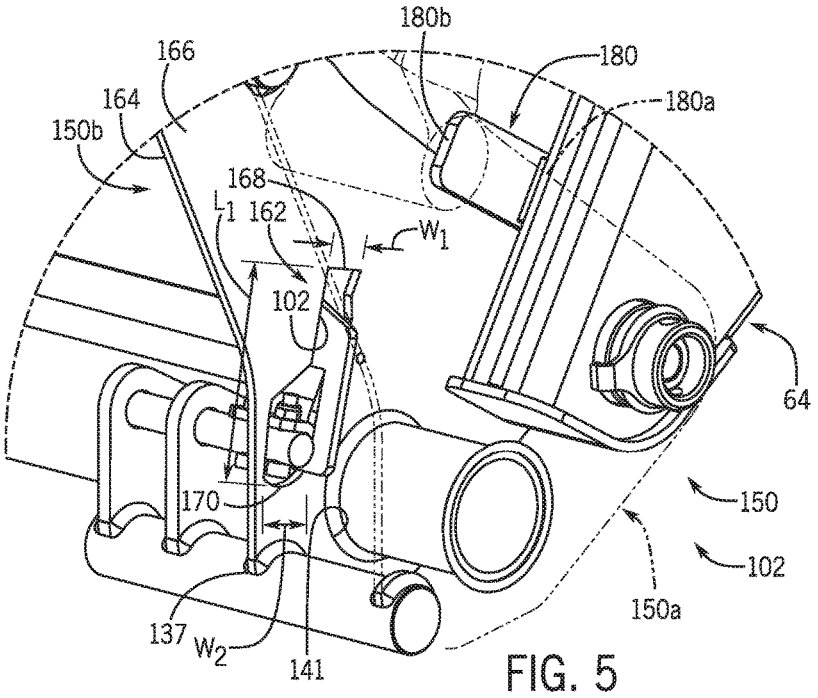
FIG. 5 is a detail view of the latching carrier and a trigger plate coupled to a loader arm of the loader taken at 5 of FIG. 4, in which an exterior bracket of a second coupler of the latching carrier is in phantom and the latching carrier is in the first, latched position.

In one example, the interior bracket 150*b* includes a latch slot 162 and the cross-rod bore 141. With reference to FIG. 4, the latch slot 162 is defined through a first surface 164 and an opposite second surface 166 of the interior bracket 150*b*. The second surface 166 faces the exterior bracket 150*a*. The second surface 166 is an inner wall of the interior bracket 150*b* and faces an outer part or the exterior bracket 150*a*. The latch slot 162 provides clearance for a portion of the latch system 112 to move relative to the interior bracket 150*b*. With reference to FIG. 5, in one example, the latch slot 162 has a first slot end 168 and a second slot end 170. The first slot end 168 is substantially elongated, and may be substantially rectangular. The second slot end 170 is rounded. The latch slot 162 generally has a width W1 at the first slot end 168 that is different, and in this example, smaller than, a second width W2 at the second slot end 170. The greater width W2 at the second slot end 170 enables a portion of the latch system 112 to pivot or rotate within the latch slot 162 and provides clearance for the portion of the latch system 112 to pass through the latch slot 162. The smaller width W1 at the first slot end 168 guides the motion of the portion of the latch system 112, which couples the bucket 52 to the loader 10, as will be discussed further herein. In one example, the latch slot 162 includes a guide surface 172, which is defined proximate the first slot end 168. The guide surface 172 contacts the portion of the latch system 112 to direct the motion of the portion of the latch system 112 through the latch slot 162. The latch slot 162 generally extends for a length L1 that is at least equal to, and in one example, greater than a height H1 (FIG. 6) of a portion of the latch system 112, which enables a portion of the latch system 112 to pass through the latch slot 162. The cross-rod bore 141 is defined through the first surface 164 and the second surface 166, and receives the cross-rod 104 therethrough. The cross-rod 104 may be fixedly coupled, via welding, for example, to the cross-rod bore 141 of the interior bracket 150*b*.

With reference to FIG. 4, the cross-rod 104 interconnects the couplers 100, 102. In one example, a first end 104*a* of the cross-rod 104 is coupled to an inner surface of the exterior bracket 120*a* and to the cross-rod bore 141 of the interior bracket 120*b*. A second end 104*b* of the cross-rod 104 is coupled to an inner surface of the exterior bracket 150*a* and to the cross-rod bore 141 of the interior bracket 150*b*. The cross-rod 104 ensures that the couplers 100, 102 move in unison.

The latch system 112 is movable relative to the couplers 100, 102 to reversibly or removably couple the bucket 52 to the loader 10. In one example, the latch system 112 is movable between a first, latched position (FIG. 6), in which the bucket 52 is securely coupled to the loader 10, and a second, unlatched position (FIG. 7), in which the bucket 52 is uncoupled from the loader 10. In one example, with reference to FIG. 4, the latching carrier 8 is moved from the second, unlatched position to the first, latched position by the second loader arm 64. In this example, the second loader arm 64 includes a trigger plate 180. The trigger plate 180 is substantially rectangular, and extends beyond a surface of the second loader arm 64 by a length L2. The length L2 is predetermined to cause a rotation of the latch system 112 when contacted by the trigger plate 180 during a movement of the second loader arm 64. The trigger plate 180 is composed of a metal or metal alloy, such as steel, which is cast, stamped, forged, etc. One end 180*a* of the trigger plate 180 is fixedly coupled to the second loader arm 64, via welding, for example, and an opposite end 180*b* of the trigger plate 180 extends beyond the surface of the second loader arm 64 and contacts the latch system 112. Generally, the trigger plate 180 is coupled to the second loader arm 64 such that when the hydraulic cylinder 38 (FIG. 1) is retracted, the end 180*b* of the trigger plate 180 of the second loader arm 64 contacts a portion of the latch system 112 to move the latch system 112 to the first, latched position substantially automatically or without operator intervention. Thus, the latch system 112 enables the bucket 52 to be coupled to the loader 10 automatically, without requiring the operator to leave the cab 28 of the loader 10 to couple the bucket 52 to the loader 10. This improves productivity by reducing downtime.

Figures 6, 7:
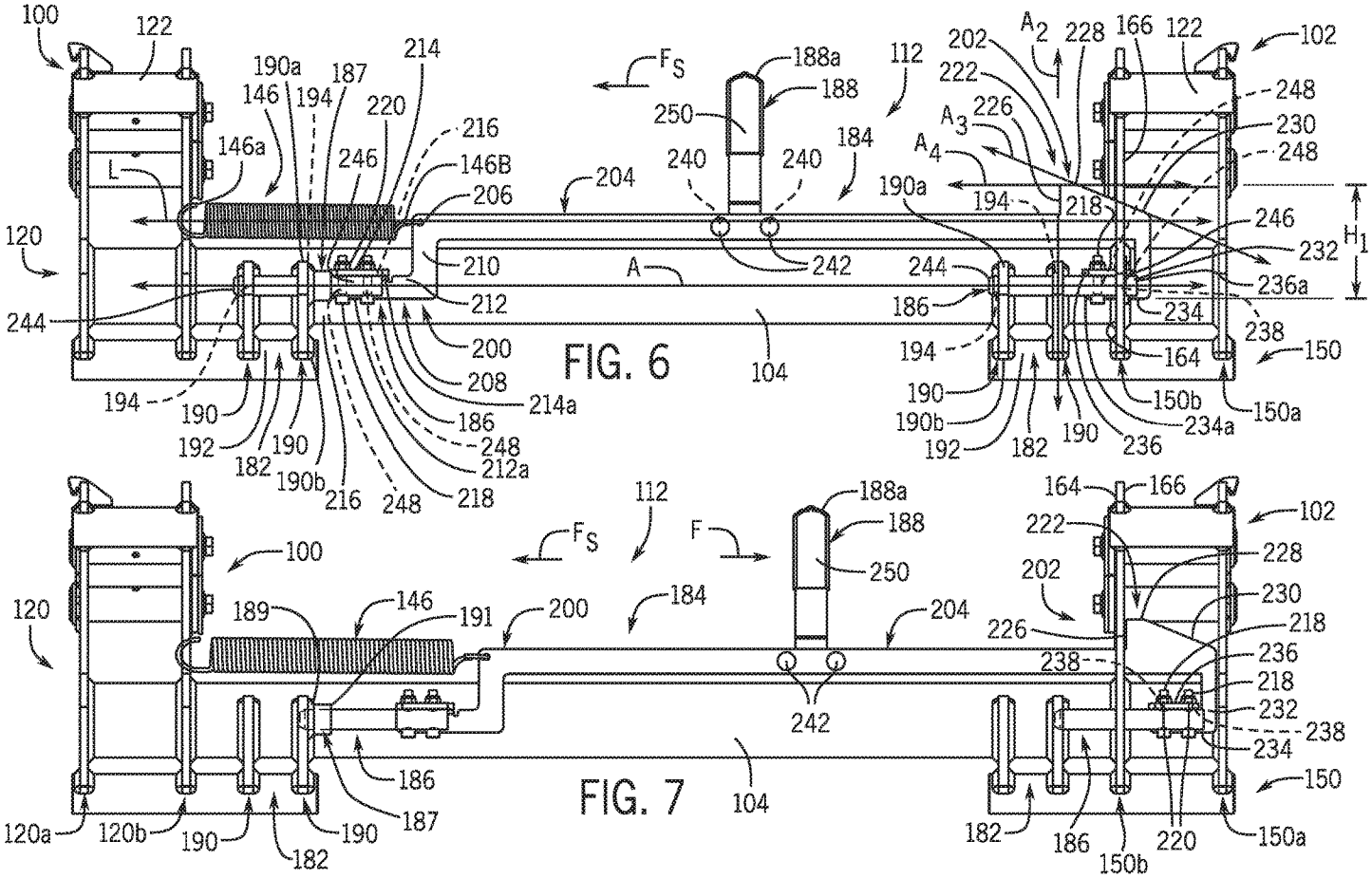
FIG. 6 is a front view of the latch system of the latching carrier in the first, latched position.
FIG. 7 is a front view of the latch system of the latching carrier in a second, unlatched position.

With reference to FIG. 6, the latch system 112 is shown in the first, latched position. The latch system 112 includes a pair of latch receptacles 182, a latch plate 184, a pair of lock pins 186, a bushing 187, the spring 146 and a graspable portion or handle 188. Generally, one latch receptacle 182 is associated with the first coupler 100, and the other latch receptacle 182 is associated with the second coupler 102. In one example, each of the pair of latch receptacles 182 include a pair of flanges 190 that cooperate to define a receptacle 192 for the respective pin receiving flanges 82 of the bucket 52. One pair of flanges 190 of one of the pair of latch receptacles 182 is spaced apart from the other pair of flanges 190 of the other one of the pair of latch receptacles 182 such that one pair of flanges 190 is associated with the first coupler 100 and receives the pin receiving flange 82 on one side of the bucket 52; and the other pair of flanges 190 is associated with the second coupler 102 and receives the pin receiving flange 82 on the other side of the bucket 52. Each of the flanges 190 are composed of a metal or metal alloy, such as steel, and are stamped, cast, forged, etc. Each flange 190 of the pair of flanges 190 defines a latch bore 194 at a first end 190*a*. The latch bores 194 of the respective pair of flanges 190 are coaxially aligned to receive one of the lock pins 186. Each flange 190 includes a second end 190*b* opposite the first end 190*a*, and the second end 190*b* of each of the flanges 190 is coupled to a support rod 196, via welding, for example. In this example, each of the couplers 100, 102 include the support rod 196. The support rod 196 is composed of a metal or metal alloy, such as steel, and is cast, stamped, forged, extruded, etc. The respective support rod 196 is coupled to the brackets 120*a*, 120*b*; 150*a*, 150*b* at the support recesses 137, and is coupled to the respective pair of latch receptacles 182. The support rods 196 provide rigidity to the couplers 100, 102 and the latch system 112.

The latch plate 184 extends between the couplers 100, 102. The latch plate 184 is movable by the trigger plate 180 to move the latch system 112 from the second, unlatched position to the first, latched position. The latch plate 184 is composed of a metal or metal alloy, such as steel, and is cast, stamped, forged, laser-cut, etc. The latch plate 184 has a first end 200 and a second end 202 that are interconnected by a midsection 204. The first end 200 is proximate the first coupler 100, and is formed integrally with the midsection 204. The first end 200 includes a second spring retainer 206 and a lock pin retainer 208. In this example, the second spring retainer 206 is a bore, which receives an end 146*b* of the spring 146. Generally, the end 146*b* is at least partially coiled or looped, and is hooked or coupled through the second spring retainer 206 to couple the spring 146 to the latch plate 184.

In one example, the lock pin retainer 208 is substantially L-shaped, such that the lock pin 186 coupled to the lock pin retainer 208 extends along an axis A that is offset from a longitudinal axis L of the latch plate 184. The axis A is substantially parallel to the longitudinal axis L. In one example, the lock pin retainer 208 has a first retainer branch 210 and a second retainer branch 212. The first retainer branch 210 is coupled to or integrally formed with the first end 200 proximate the second spring retainer 206. The first retainer branch 210 extends along an axis that is substantially perpendicular to the longitudinal axis L. The second retainer branch 212 is coupled to or integrally formed with the first retainer branch 210, and extends outwardly from the first retainer branch 210 toward the latch receptacle 182 associated with the first coupler 100. An end 212*a* of the second retainer branch 212 includes a pin flange 214. In one example, the pin flange 214 is formed by bending a section of the end 212*a* over to define a partial concave recess 214*a* for surrounding a portion of the lock pin 186. It should be noted, however, that the pin flange 214 may be composed through any other technique or with any other shape that facilitates the securing of one of the lock pins 186 to the second retainer branch 212. In this example, the pin flange 214 defines a pair of bores 216, and each bore 216 is sized to receive a mechanical fastener 218, such as a bolt, therethrough. In this example, the mechanical fastener 218 is at least partially threaded and cooperates with a nut 220 to couple or secure the lock pin 186 to the pin flange 214.

The second end 202 is proximate the second coupler 102, and is formed integrally with the midsection 204. The second end 202 of the latch plate 184 includes a latch plate retaining flange 222 and a second lock pin retainer 224. The second end 202 also defines the height H1 of the latch plate 184. The latch plate retaining flange 222 includes a first wall 226, a second wall 228 and a third wall 230 that cooperate to hold the latch plate 184 when the latch system 112 is in the second, unlatched position. In this example, the first wall 226 extends along an axis A2 that is substantially perpendicular to the longitudinal axis L. With reference to FIG. 7, the first wall 226 contacts the second surface 166 of the interior bracket 150*b* when the latch system 112 is in the second, unlatched position. Stated another way, the contact between the first wall 226 and the second surface 166 of the interior bracket 150*b* holds the latch plate 184, and thus, the latch system 112, in the second, unlatched position, and as will be discussed, once the first wall 226 moves out of contact with the interior bracket 150*b*, the spring 146 pulls the latch plate 184, and thus, the latch system 112 into the first, latched position substantially automatically or without operator assistance. The first wall 226 contacts the interior bracket 150*b* proximate the latch slot 162 such that contact between the trigger plate 180 (FIG. 4) and the latch plate retaining flange 222 of the latch plate 184 rotates the latch plate 184 until the first wall 226 is no longer in contact with the interior bracket 150*b* and the latch plate 184 is pulled through the latch slot 162 by the spring 146. Thus, the first wall 226 forms an engagement surface for the latch plate retaining flange 222 of the latch plate 184.

With reference to FIG. 6, the second wall 228 is coupled or formed integrally between the first wall 226 and the third wall 230. In this example, the second wall 228 extends along an axis A4, which is substantially parallel to the longitudinal axis L. The second wall 228 reinforces the first wall 226. The third wall 230 is coupled to or formed integrally with the second wall 228 and the second lock pin retainer 224. The third wall 230 extends along an axis A3, which is transverse or oblique to the longitudinal axis L and the axis A4. A portion of the third wall 230 is received within the latch slot 162 when the latch system 112 is in the first, latched position (FIG. 6).

The second lock pin retainer 224 is substantially L-shaped, such that the lock pin 186 coupled to the second lock pin retainer 224 also extends along the axis A. In one example, the second lock pin retainer 224 has a third retainer branch 232 and a fourth retainer branch 234. The third retainer branch 232 is coupled to or integrally formed with the third wall 230. The third retainer branch 232 extends along an axis that is substantially perpendicular to the longitudinal axis L. The fourth retainer branch 234 is coupled to or integrally formed with the third retainer branch 232, and extends outwardly from the third retainer branch 232 toward the latch receptacle 182 associated with the second coupler 102. An end 234*a* of the fourth retainer branch 234 includes a second pin flange 236. In one example, the second pin flange 236 is formed by bending a section of the end 234*a* over to define a partial concave recess 236*a* for surrounding a portion of the lock pin 186. It should be noted, however, that the second pin flange 236 may be composed through any other technique or with any other shape that facilitates the securing of one of the lock pins 186 to the fourth retainer branch 234. In this example, the second pin flange 236 defines a pair of bores 238, and each bore 238 is sized to receive the mechanical fastener 218, such as a bolt, therethrough. In this example, the mechanical fastener 218 is at least partially threaded and cooperates with the nut 220 to couple or secure the lock pin 186 to the second pin flange 236.

The midsection 204 extends between the first end 200 and the second end 202 of the latch plate 184. The midsection 204 is substantially rectangular, and extends along the longitudinal axis L. In this example, the midsection 204 defines a pair of bores 240. Each of the pair of bores 240 receives a respective mechanical fastener 242, such as a bolt, to couple the handle 188 to the latch plate 184. In one example, the mechanical fasteners 242 are at least partially threaded to receive a corresponding nut to couple the handle 188 to the midsection 204.

The pair of lock pins 186 are received through the respective one of the pair of pin receiving flanges 82 of the bucket 52 (FIG. 3) and the respective one of the pair of latch receptacles 182 to securely couple the bucket 52 to the respective coupler 100, 102. In this example, each of the lock pins 186 is cylindrical, and is composed of a metal or metal alloy, such as steel, and is cast, extruded, forged, etc. Each of the lock pins 186 has a first pin end 244 and a second pin end 246. The first pin end 244 is tapered, which aids in guiding the lock pin 186 into and through the respective pin receiving flange 82 and latch receptacle 182. Generally, the lock pins 186 have a length that is predetermined so that the first pin end 244 extends beyond a side of one of the flanges 190 of the respective latch receptacle 182 when the bucket 52 is secured to the respective coupler 100, 102 and the second pin end 246 is adjacent to a side of the other flange 190 of the respective latch receptacle 182 (FIG. 3). The second pin end 246 defines a pair of pin bores 248. Each of the pin bores 248 receive a respective one of the mechanical fasteners 218 to couple the lock pin 186 to the respective one of the lock pin retainer 208 and the second lock pin retainer 224.

With reference to FIG. 6, the bushing 187 contacts the pin flange 214 of the lock pin retainer 208 to limit the motion of the latch plate 184 when pulled by the spring 146 into the first, latched position. The bushing 187 is composed of a metal or metal alloy, and is cast, stamped, forged, machined, etc. With reference to FIG. 7, the bushing 187 has a first bushing end 189 and an opposite second bushing end 191. The first bushing end 189 is fixedly coupled to one of the flanges 190, via welding, for example. Thus, a central bore of the bushing 187 is generally coaxially aligned with the latch bores 194 of the flanges 190 to enable the respective lock pin 186 to pass through the bushing 187. The second bushing end 191 contacts the pin flange 214 when the latch system 112 is in the first, latched position (FIG. 6). The bushing 187 is sized to enable a portion of one of the lock pins 186 to be positioned within the bushing 187 in both the first, latched position and the second, unlatched position.

The spring 146 provides a spring force Fs, which maintains the latch system 112 in the first, latched position. Generally, the spring 146 is composed of a metal or metal alloy, such as steel, which is coiled to define the spring 146. In one example, the spring 146 is an extension spring, which has the ends 146*a*, 146*b*. The end 146*a* is coupled to the first coupler 100, while the end 146*b* is coupled to the latch plate 184. In the second, unlatched position, the spring 146 is elongated.

The handle 188 enables an operator to move the latch plate 184, and thus, the latch system 112, into the second, unlatched position. In order to move the latch plate 184, and thus, the latch system 112 into the second, unlatched position, the operator applies a force F to the handle 188 that is greater than the spring force Fs to overcome the spring force Fs of the spring 146 and move the latch plate 184 into the second, unlatched position. The handle 188 comprises any suitable device that may be manipulated by an operator to move the latch plate 184. In this example, the handle 188 defines a pair of bores that receive the mechanical fasteners 242 to couple the handle 188 to the midsection 204 of the latch plate 184. It should be noted, however, that the handle 188 may be integrally formed with the latch plate 184, if desired. In this example, an end 188*a* of the handle 188 includes an overmolded polymeric portion 250 for operator comfort, however, it should be noted that the handle 188 need not include the overmolded polymeric portion 250.

In one example, in order to assemble the latching carrier 8, with reference to FIGS. 3 and 4, with the brackets 120 formed, the exterior bracket 120*a* is coupled to the support rod 196 at the support recesses 137, via welding, for example, and the interior bracket 120*b* is coupled to the support rod 196 at the support recesses 137, via welding, for example. The hook retaining pin 122 is coupled to the retaining recesses 136, via welding, for example. With the flanges 190 formed, one pair of flanges 190 are coupled to the support rod 196, via welding, for example, so as to be spaced apart to receive the pin receiving flanges 82 of the bucket 52 (FIG. 3).

With the second brackets 150 formed, the exterior bracket 150*a* is coupled to the support rod 196 at the support recesses 137, via welding, for example, and the interior bracket 150*b* is coupled to the support rod 196 at the support recesses 137, via welding, for example. The hook retaining pin 122 is coupled to the retaining recesses 136, via welding, for example. The other pair of flanges 190 are coupled to the support rod 196, via welding, for example, so as to be spaced apart to receive the pin receiving flanges 82 of the bucket 52 (FIG. 3).

With the cross-rod 104 formed, the cross-rod 104 is inserted through the cross-rod bore 141 of the interior bracket 120*b*, and is coupled to the exterior bracket 120*a* and the cross-rod bore 141, via welding, for example. The cross-rod 104 is inserted through the cross-rod bore 141 of the interior bracket 150*b*, and is coupled to the exterior bracket 150*a* and the cross-rod bore 141, via welding, for example.

With the latch plate 184, the lock pins 186 and the handle 188 formed, the handle 188 is coupled to the latch plate 184 via the mechanical fasteners 242. The latch plate 184 is positioned between the couplers 100, 102. One of the lock pins 186 is coupled to the lock pin retainer 208 via the mechanical fasteners 218 and nuts 220; and the other of the lock pins 186 is coupled to the second lock pin retainer 224 via the mechanical fasteners 218 and nuts 220. The end 146*a* of the spring 146 is coupled to the spring retainer 140, and the end 146*b* of the spring 146 is coupled to the second spring retainer 206. The trigger plate 180 is also formed, and coupled to the second loader arm 64, via welding, for example.

Figure 8:
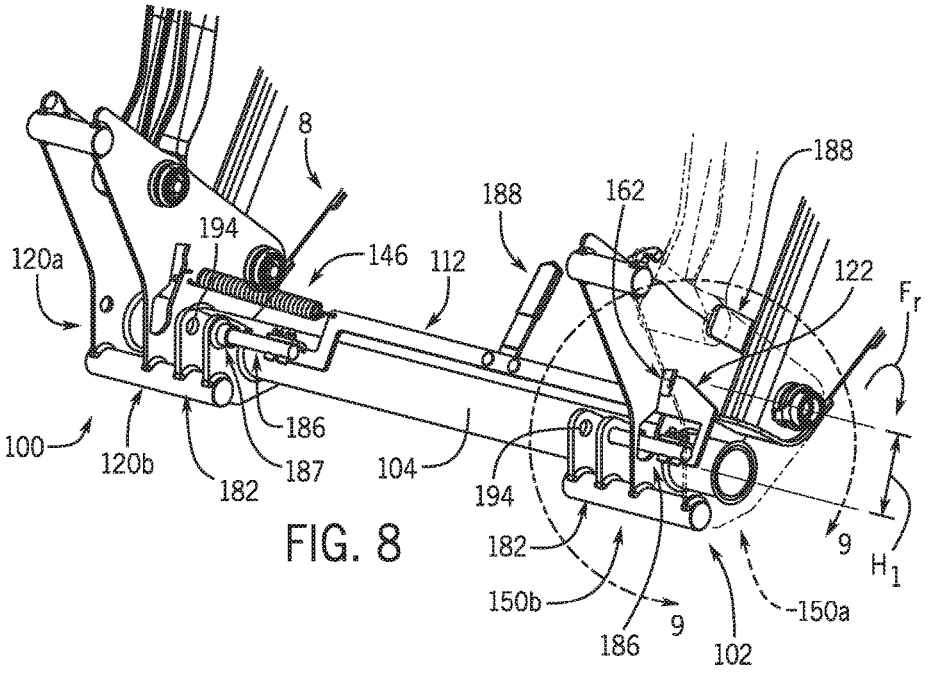
FIG. 8 is a detail perspective view of the latch system of the latching carrier of the loader in the second, unlatched position.
Figure 9:
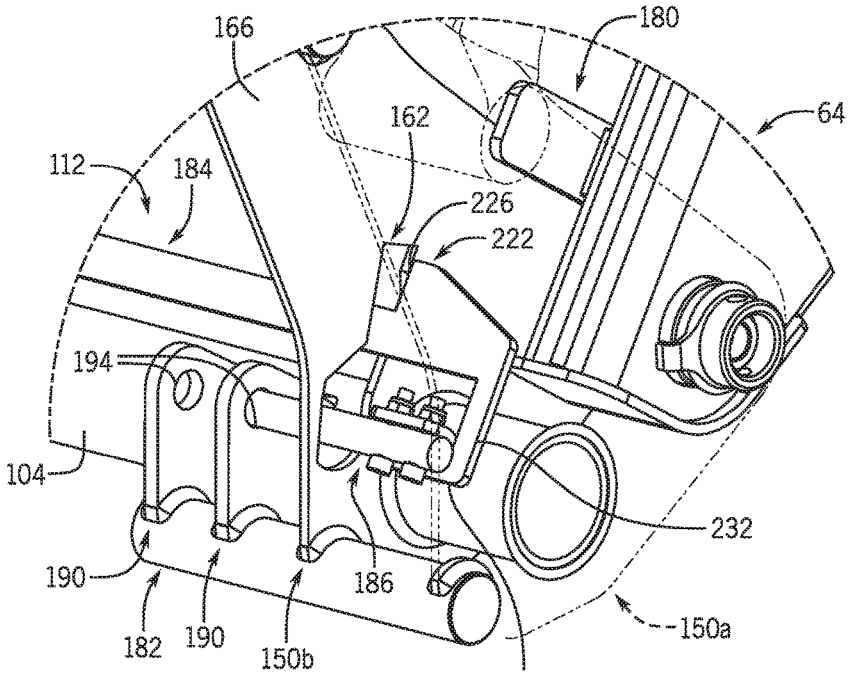
FIG. 9 is a detail view of the latching carrier and the trigger plate coupled to the loader arm of the loader taken at 9 of FIG. 8, in which the exterior bracket of the second coupler of the latching carrier is in phantom and the latching carrier is in the second, unlatched position.

With reference to FIG. 7, in order to couple the bucket 52 (FIG. 3) to the loader 10, the operator manipulates the handle 188 and applies the force F to overcome the spring force Fs to secure the first wall 226 of the latch plate retaining flange 222 against the second surface 166 of the interior bracket 150*b*. In one example, the operator applies the force F to pull the latch plate 184 laterally or horizontally toward the second brackets 150 so that the latch plate retaining flange 222 passes through the latch slot 162. With reference to FIGS. 8 and 9, once the latch plate 184 has moved through the latch slot 162, the operator applies a clockwise rotational force Fr to move the first wall 226 into contact with the second surface 166. The contact between the first wall 226 and the second surface 166 holds the latch plate 184, and thus, the latch system 112, in the second, unlatched position.

Figure 10:
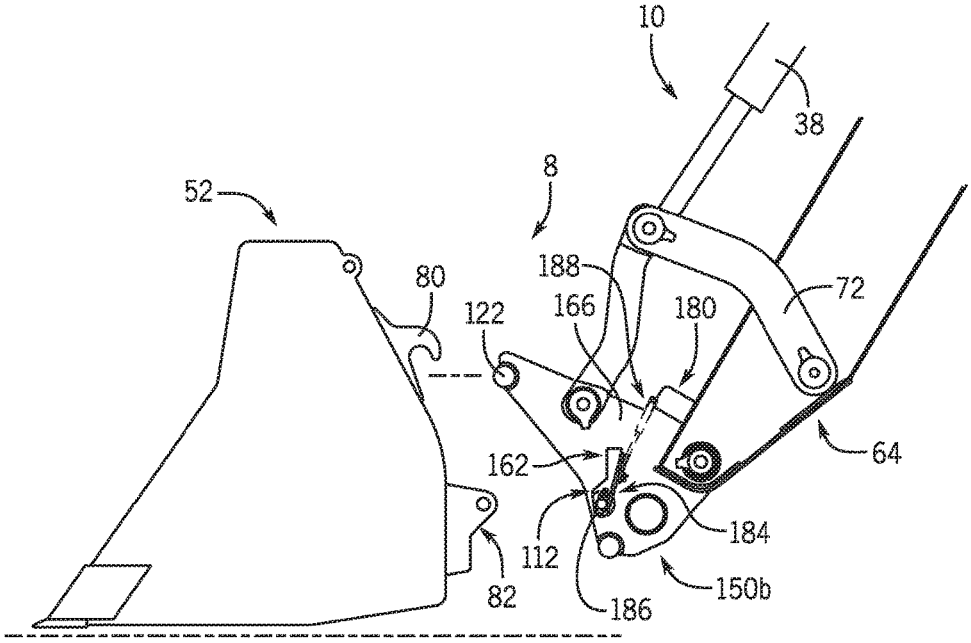
FIG. 10 is a side view of the latching carrier and the loader, in which the latch system of the latching carrier is in the second, unlatched position for coupling to the bucket and the exterior bracket of the second coupler of the latching carrier is removed for clarity.
Figure 11:
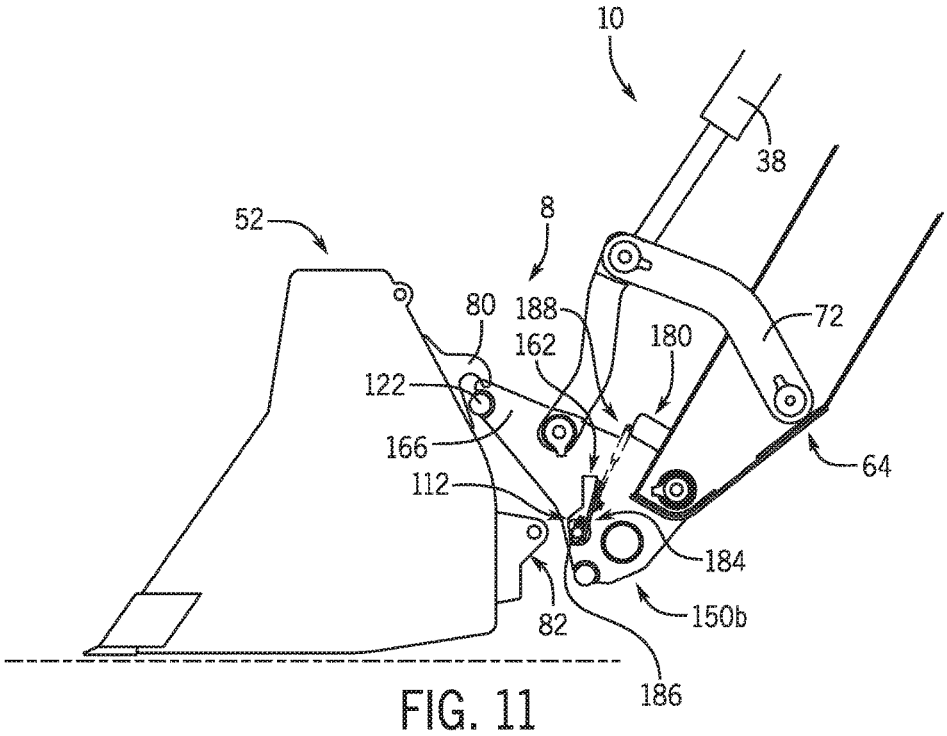
FIG. 11 is a side view of the latching carrier and the loader advanced toward the bucket to couple the latching carrier to a first mounting feature of the bucket and the exterior bracket of the second coupler of the latching carrier is removed for clarity.
Figure 12:
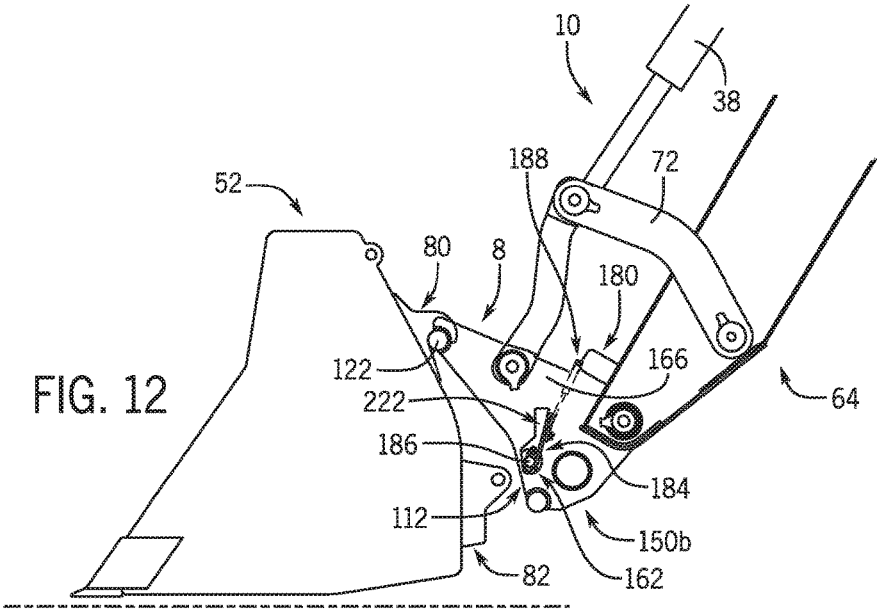
FIG. 12 is a side view of the latching carrier and the loader, with the latching carrier coupled to the first mounting feature of the bucket, and the latching carrier and the loader advanced further toward the bucket to couple the latching carrier to a second mounting feature of the bucket, with the exterior bracket of the second coupler of the latching carrier is removed for clarity.
Figure 13:
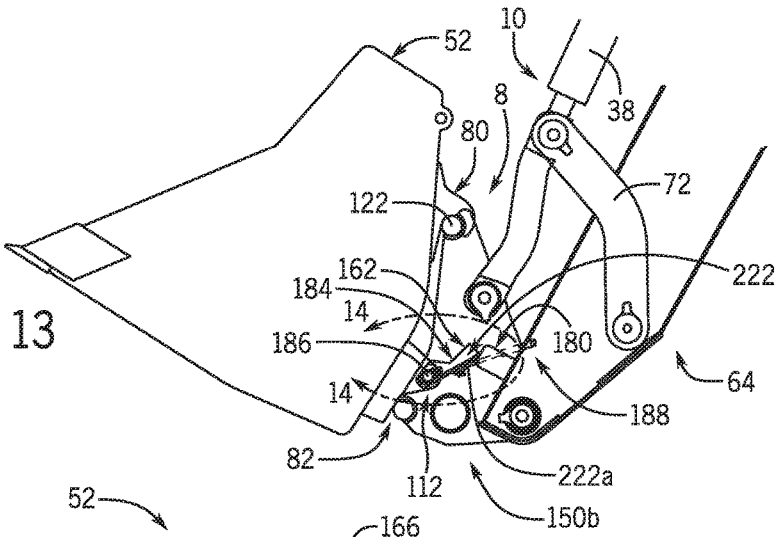
FIG. 13 is a side view of the latching carrier and the loader, in which the trigger plate of the loader arm has contacted a latch plate of the latch system to begin coupling the latching carrier to the second mounting feature of the bucket and the exterior bracket of the second coupler of the latching carrier is removed for clarity.
Figure 14:
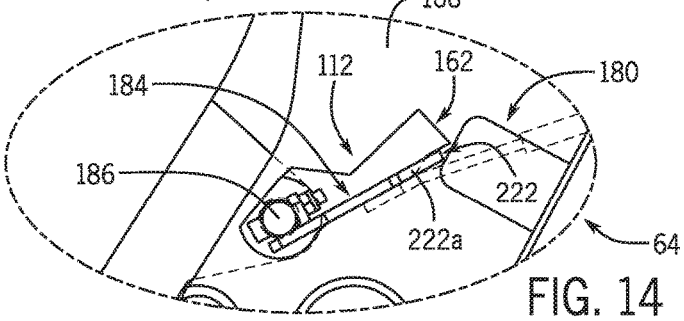
FIG. 14 is a detail side view of the latch plate and the trigger plate of FIG. 13 taken at 14 of FIG. 13, with the exterior bracket of the second coupler of the latching carrier is removed for clarity.
Figure 15:
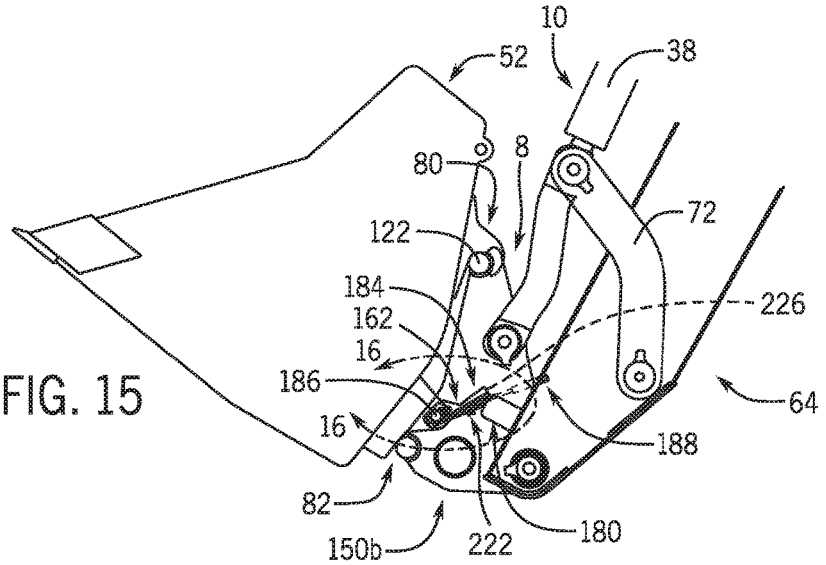
FIG. 15 is a side view of the latching carrier and the loader, in which the trigger plate of the loader arm has moved the latch plate of the latch system such that the latch plate passes through a latch slot to couple the latching carrier to the second mounting feature of the bucket, with the exterior bracket of the second coupler of the latching carrier is removed for clarity.
Figure 16:
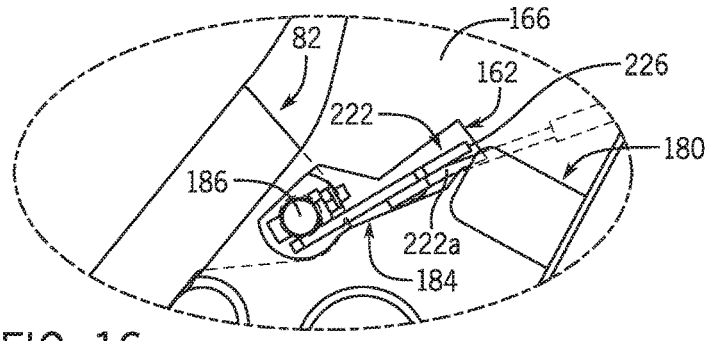
FIG. 16 is a detail side view of the latch plate, the latch slot and the trigger plate of FIG. 15 taken at 16 of FIG. 15, with the exterior bracket of the second coupler of the latching carrier is removed for clarity.
Figure 17:
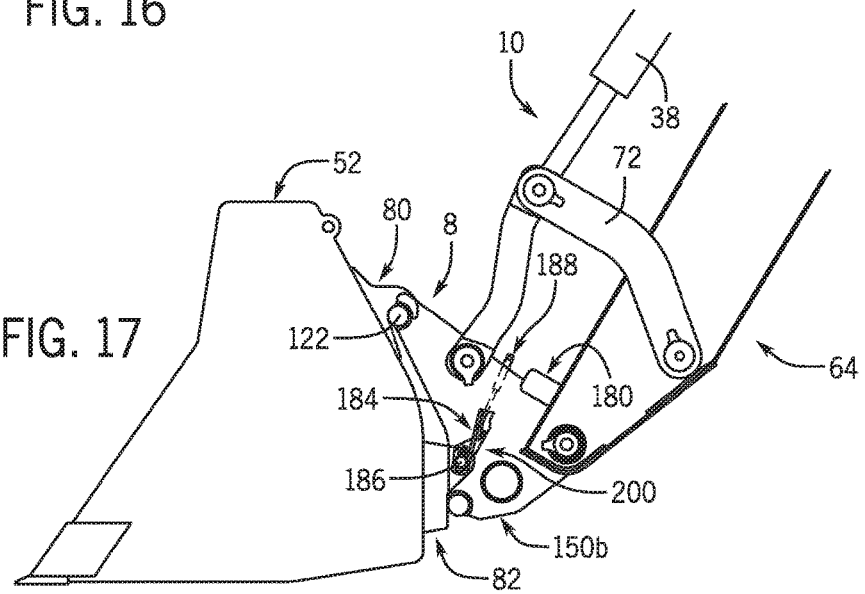
FIG. 17 is a side view of the bucket coupled to the latching carrier of the loader, with the latch system in the first, latched position and the exterior bracket of the second coupler of the latching carrier is removed for clarity.

With the latch system 112 in the second, unlatched position, with reference to FIG. 10, in order to couple the bucket 52 to the loader 10, with the operator in the cab 28 of the loader 10, the loader 10 is advanced toward the bucket 52. With reference to FIG. 11, the loader arms 62, 64 are moved, via actuation of the hydraulic cylinders 36, 38 (FIG. 1) to couple or hook the hook 80 of the bucket 52 onto the hook retaining pin 122 of the couplers 100, 102, as shown in FIG. 12. With the hooks 80 coupled to the latching carrier 8, the loader arms 62, 64 are retracted, via actuation of the hydraulic cylinders 36, 38 (FIG. 1), to roll back the bucket 52 and move the bucket 52 closer to the latching carrier 8. With reference to FIG. 13, the loader arms 62, 64 (FIG. 1) are retracted, via a retraction of the hydraulic cylinders 36, 38 (FIG. 1), which causes the trigger plate 180 to contact a surface 222*a* of the latch plate retaining flange 222, as shown in FIG. 14. The bucket 52 is continued to be rolled back toward the loader arms 62, 64, via a further retraction of the hydraulic cylinders 36, 38 (FIG. 1), and the contact between the trigger plate 180 and the surface 222*a* of the latch plate retaining flange 222 causes the trigger plate 180 to rotate the latch plate 184 during the roll back until the first wall 226 is no longer in contact with the second surface 166 and the latch plate 184 is aligned with the latch slot 162, as shown in FIGS. 15 and 16. Once the latch plate 184 passes through the latch slot 162, the spring 146 pulls the latch plate 184, and the latch system 112 into the first, latched position such that the lock pins 186 are received in the latch receptacles 182 and engage each of the pin receiving flange 82 of the bucket 52 to securely couple the bucket 52 to the loader 10 as shown in FIGS. 3 and 17.

In order to uncouple the bucket 52 from the loader 10, with reference to FIG. 7, the operator manipulates the handle 188 and applies the force F to overcome the spring force Fs to secure the first wall 226 of the latch plate retaining flange 222 against the second surface 166 of the interior bracket 150*b*. As discussed, the contact between the latch plate retaining flange 222 and the second surface 166 of the interior bracket 150*b* retains the latch system 112 in the second, unlatched position.

It will be understood that the latch system 112 associated with the loader 10 described with regard to FIGS. 1-17 may be configured differently to provide improved attachment of the bucket 52 to the couplers 100, 102. In one example, with reference to FIG. 18, an exemplary latch system 300 for use with a latching carrier 302 to couple an attachment, such as the bucket 52 (FIG. 2) to the loader arms 62, 64 of the loader 10 (FIG. 1) is shown. As the latching carrier 302 includes features that are substantially similar to or the same as the latching carrier 8 discussed with regard to FIGS. 1-17, the same reference numerals will be used to denote the same or similar features. The latching carrier 302 reversibly or removably couples the bucket 52 (FIG. 2) to the loader 10 (FIG. 1). The latching carrier 302 includes the first and second (left and right) couplers 100, 102, connected by the cross-rod 104, that mount to the distal ends of the respective loader arms 62, 64 via the coupling pins 106. The additional pins 108, 110 pivotally couple the pivot linkages 70, 72 between the loader arms 62, 64 and the respective first and second couplers 100, 102. The latching carrier 302 also includes the latch mechanism or latch system 300, which secures the bucket 52 to the latching carrier 8, and thus, the loader arms 62, 64 (FIG. 2).

The latch system 300 is movable relative to the couplers 100, 102 to reversibly or removably couple the bucket 52 to the loader 10 (FIG. 1). In one example, the latch system 300 is movable between a first, latched position (FIG. 18), in which the bucket 52 is securely coupled to the loader 10, and a second, unlatched position (FIG. 19), in which the bucket 52 is uncoupled from the loader 10. In one example, with reference to FIG. 20, the latching carrier 8 is moved from the second, unlatched position to the first, latched position by the trigger plate 180 of the second loader arm 64, as discussed with regard to the latch system 112 of FIGS. 1-17. As discussed, when the hydraulic cylinder 38 (FIG. 1) is retracted, the end 180*b* of the trigger plate 180 of the second loader arm 64 contacts a portion of the latch system 300 to move the latch system 300 to the first, latched position substantially automatically or without operator intervention. Thus, the latch system 300 also enables the bucket 52 to be coupled to the loader 10 automatically, without requiring the operator to leave the cab 28 of the loader 10 to couple the bucket 52 to the loader 10. This improves productivity by reducing downtime.

Figures 18, 19:
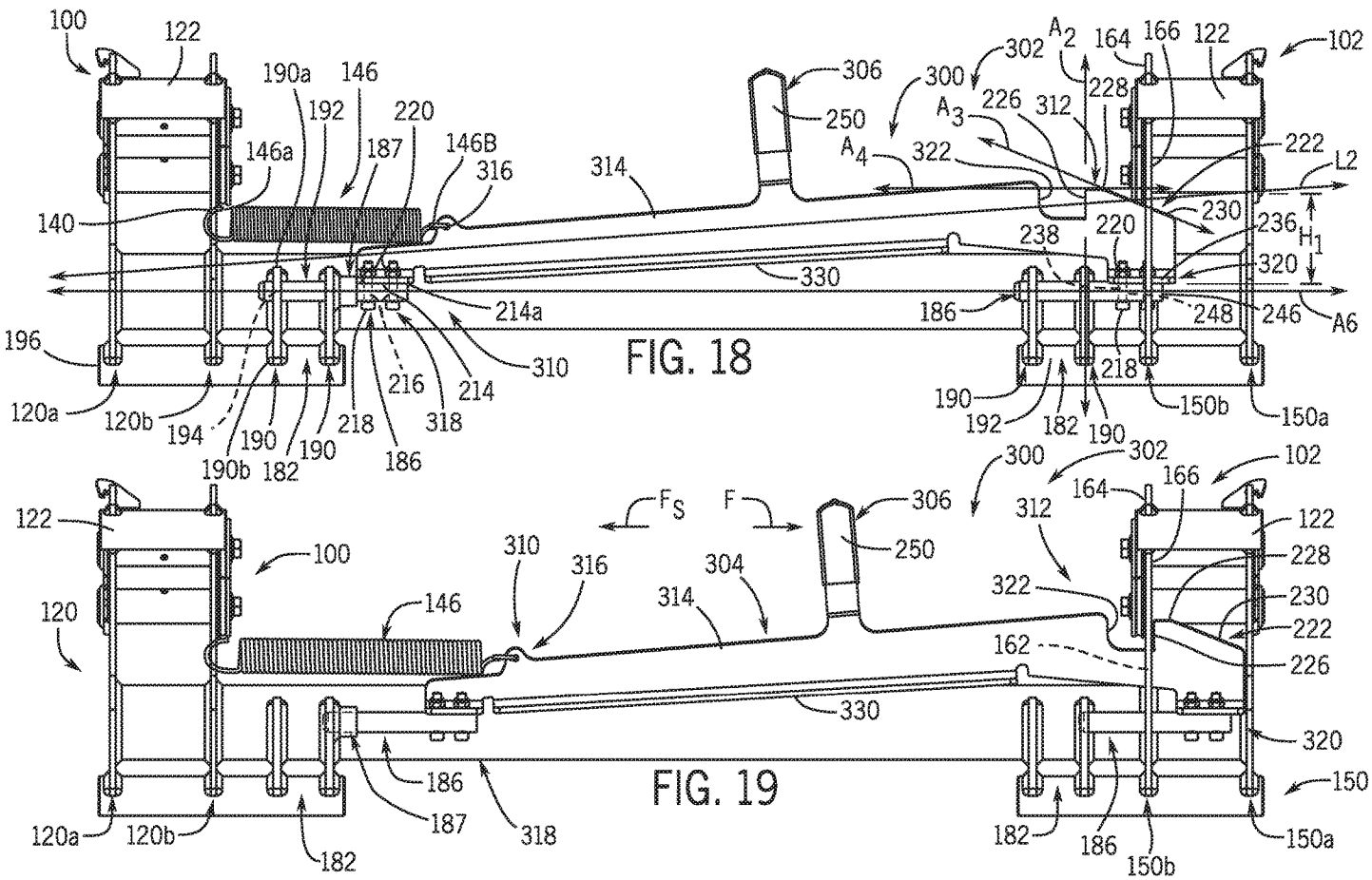
FIG. 18 is a front view of a latch system of an exemplary latching carrier that may be used to couple the bucket to the loader in the first, latched position.
FIG. 19 is a front view of the latch system of the latching carrier of FIG. 18 in a second, unlatched position.

With reference to FIG. 18, the latch system 300 is shown in the first, latched position. The latch system 300 includes the pair of latch receptacles 182, a latch plate 304, the pair of lock pins 186, the bushing 187, the spring 146 and a graspable portion or handle 306. One of the latch receptacles 182 is associated with the first coupler 100, and the other of the latch receptacles 182 is associated with the second coupler 102. As discussed, each of the pair of latch receptacles 182 include the pair of flanges 190 that cooperate to define the receptacle 192 for the respective pin receiving flanges 82 of the bucket 52 (FIG. 3). Each flange 190 of the pair of flanges 190 defines the latch bore 194 at the first end 190*a*. The latch bores 194 of the respective pair of flanges 190 are coaxially aligned to receive one of the lock pins 186. Each flange 190 includes the second end 190*b* opposite the first end 190*a*, and the second end 190*b* of each of the flanges 190 is coupled to the support rod 196, via welding, for example. The respective support rod 196 is coupled to the brackets 120*a*, 120*b*; 150*a*, 150*b* at the support recesses 137, and is coupled to the respective pair of latch receptacles 182. The support rods 196 provide rigidity to the couplers 100, 102 and the latch system 300.

The latch plate 304 extends between the couplers 100, 102. The latch plate 304 is movable by the trigger plate 180 to move the latch system 300 from the second, unlatched position (FIG. 19) to the first, latched position (FIG. 18). The latch plate 304 is composed of a metal or metal alloy, such as steel, and is cast, stamped, forged, laser-cut, etc. With reference to FIG. 18, the latch plate 304 has a first end 310 and a second end 312 that are interconnected by a midsection 314. The first end 310 is proximate the first coupler 100, and is formed integrally with the midsection 314. The first end 310 includes a second spring retainer 316 and a lock pin retainer 318. In this example, the second spring retainer 316 is a bore, which receives the end 146*b* of the spring 146. Generally, the end 146*b* is at least partially coiled or looped, and is hooked or coupled through the second spring retainer 316 to couple the spring 146 to the latch plate 304.

In this example, the lock pin retainer 318 is at the first end 310 such that the lock pin 186 coupled to the lock pin retainer 318 extends along an axis A6 that intersects or is oblique to a longitudinal axis L2 of the latch plate 304. In one example, the lock pin retainer 318 extends outwardly from the latch plate 304 toward the latch receptacle 182 associated with the first coupler 100. The lock pin retainer 318 includes the pin flange 214. The pin flange 214 defines the pair of bores 216, and each bore 216 is sized to receive the mechanical fastener 218, such as a bolt, therethrough. In this example, the mechanical fastener 218 is at least partially threaded and cooperates with the nut 220 to couple or secure the lock pin 186 to the pin flange 214.

The second end 312 is proximate the second coupler 102, and is formed integrally with the midsection 314. The second end 312 of the latch plate 304 includes the latch plate retaining flange 222 and a second lock pin retainer 320. In this example, the latch plate retaining flange 222 is defined adjacent to a notch 322. The notch 322 is sized to enable the latch plate retaining flange 222 to contact the second surface 166 of the interior bracket 150*b* while a remainder of the latch plate 304 is positioned adjacent to the first surface 164 of the interior bracket 150*b*. Stated another way, the notch 322 provides clearance to enable the latch plate retaining flange 222 to contact the second surface 166 to retain the latch plate 304, and thus, the latch system 300 in the second, unlatched position (FIG. 19). The notch 322 is U-shaped, however, the notch 322 may have any desired shape. The second end 312 also defines the height H1 of the latch plate 304.

Figure 21:
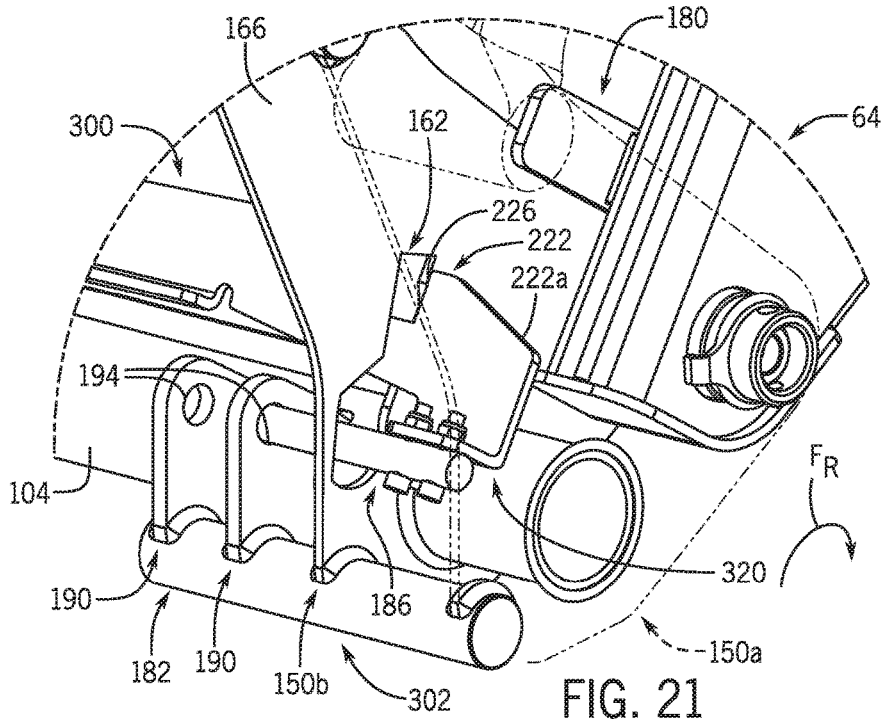
FIG. 21 is a detail perspective view of the second end of the latching carrier of FIG. 18, in which the trigger plate is coupled to the loader arm of the loader, the exterior bracket of the second coupler of the latching carrier is in phantom and the latching carrier is in the second, unlatched position.

The latch plate retaining flange 222 includes the first wall 226, the second wall 228 and the third wall 230 that cooperate to hold the latch plate 304 when the latch system 300 is in the second, unlatched position. In this example, the first wall 226 extends along the axis A2, which is substantially perpendicular and intersects to the longitudinal axis L2. The first wall 226 contacts the second surface 166 of the interior bracket 150*b* when the latch system 300 is in the second, unlatched position. The contact between the first wall 226 and the second surface 166 of the interior bracket 150*b* holds the latch plate 304, and thus, the latch system 300, in the second, unlatched position, and once the first wall 226 moves out of contact with the interior bracket 150*b*, the spring 146 pulls the latch plate 304, and thus, the latch system 300 into the first, latched position substantially automatically or without operator assistance. With reference to FIG. 21, the first wall 226 contacts the interior bracket 150*b* proximate the latch slot 162 such that contact between the trigger plate 180 and the latch plate retaining flange 222 of the latch plate 304 rotates the latch plate 304 until the first wall 226 is no longer in contact with the interior bracket 150*b* and the latch plate 304 is pulled through the latch slot 162 by the spring 146 (FIG. 18). Thus, the first wall 226 forms an engagement surface for the latch plate retaining flange 222 of the latch plate 304.

With reference to FIG. 18, the second wall 228 is coupled or formed integrally between the first wall 226 and the third wall 230. In this example, the second wall 228 extends along the axis A4 (FIG. 6), which is intersects the longitudinal axis L2. The second wall 228 reinforces the first wall 226. The third wall 230 is coupled to or formed integrally with the second wall 228 and the second lock pin retainer 320. The third wall 230 extends along the axis A3 (FIG. 6), which is transverse or oblique to the longitudinal axis L2 and the axis A4. A portion of the third wall 230 is received within the latch slot 162 when the latch system 300 is in the first, latched position (FIG. 6).

The second lock pin retainer 320 is defined at the second end 312, substantially opposite the latch plate retaining flange 222. The lock pin 186 coupled to the second lock pin retainer 320 also extends along the axis A6. In one example, the second lock pin retainer 320 extends outwardly from the second end 312 for coupling the lock pin 186 to the latch plate 304 such that the lock pin 186 extends toward the latch receptacle 182 associated with the second coupler 102. The second lock pin retainer 320 includes the second pin flange 236. The second pin flange 236 defines the pair of bores 238, and each bore 238 is sized to receive the mechanical fastener 218, such as a bolt, therethrough. In this example, the mechanical fastener 218 is at least partially threaded and cooperates with the nut 220 to couple or secure the lock pin 186 to the second pin flange 236.

The midsection 314 extends between the first end 310 and the second end 312 of the latch plate 304. The midsection 204 is substantially rectangular, and extends along the longitudinal axis L2. In this example, the midsection 314 includes a reinforcing lip 330, which extends along a bottom surface of the midsection 314 from the first end 310 to the second end 312. As will be discussed, the midsection 314 is also integrally formed with the handle 306. The handle 306 extends outwardly from the midsection 314 along a top surface of the midsection 314, which is opposite the bottom surface and the reinforcing lip 330.

The pair of lock pins 186 are received through the respective one of the pair of pin receiving flanges 82 of the bucket 52 (FIG. 3) and the respective one of the pair of latch receptacles 182 to securely couple the bucket 52 to the respective coupler 100, 102 of the latching carrier 302. Each of the pin bores 248 of the second pin end 246 receive a respective one of the mechanical fasteners 218 to couple the lock pin 186 to the respective one of the lock pin retainer 318 and the second lock pin retainer 320.

With reference to FIG. 18, the bushing 187 contacts the pin flange 214 of the lock pin retainer 318 to limit the motion of the latch plate 304 when pulled by the spring 146 into the first, latched position. The spring 146 provides the spring force Fs, which maintains the latch system 300 in the first, latched position. The end 146*a* is coupled to the first coupler 100, while the end 146*b* is coupled to the latch plate 304. In the second, unlatched position, the spring 146 is elongated.

The handle 306 enables an operator to move the latch plate 304, and thus, the latch system 300, into the second, unlatched position. In order to move the latch plate 304, and thus, the latch system 300 into the second, unlatched position, the operator applies the force F (FIG. 9) to the handle 188 that is greater than the spring force Fs to overcome the spring force Fs of the spring 146 and move the latch plate 304 into the second, unlatched position. The handle 306 comprises any suitable device that may be manipulated by an operator to move the latch plate 304. In this example, the handle 306 is integrally formed with the latch plate 304, and extends from the midsection 314 of the latch plate 304. In this example, an end 306*a* of the handle 306 includes the overmolded polymeric portion 250 for operator comfort, however, it should be noted that the handle 306 need not include the overmolded polymeric portion 250.

As the assembly of the latching carrier 302 is substantially the same as the assembly of the latching carrier 8, the differences between the assembly of the latching carrier 302 and the assembly of the latching carrier 8 will be discussed in detail herein. With the latch plate 304 integrally formed with the handle 306 and the lock pins 186 formed, the latch plate 304 is positioned between the couplers 100, 102. One of the lock pins 186 is coupled to the lock pin retainer 318 via the mechanical fasteners 218 and nuts 220; and the other of the lock pins 186 is coupled to the second lock pin retainer 320 via the mechanical fasteners 218 and nuts 220. The end 146*a* of the spring 146 is coupled to the spring retainer 140, and the end 146*b* of the spring 146 is coupled to the second spring retainer 316.

With reference to FIG. 19, in order to couple the bucket 52 (FIG. 3) to the loader 10, the operator manipulates the handle 306 and applies the force F to overcome the spring force Fs to secure the first wall 226 of the latch plate retaining flange 222 against the second surface 166 of the interior bracket 150*b*. In one example, the operator applies the force F to pull the latch plate 304 laterally or horizontally toward the second brackets 150 so that the latch plate retaining flange 222 passes through the latch slot 162. With reference to FIG. 21, once the latch plate 304 has moved through the latch slot 162, the operator applies a clockwise rotational force Fr to move the first wall 226 into contact with the second surface 166. The contact between the first wall 226 and the second surface 166 holds the latch plate 304, and thus, the latch system 300, in the second, unlatched position.

Figure 20:
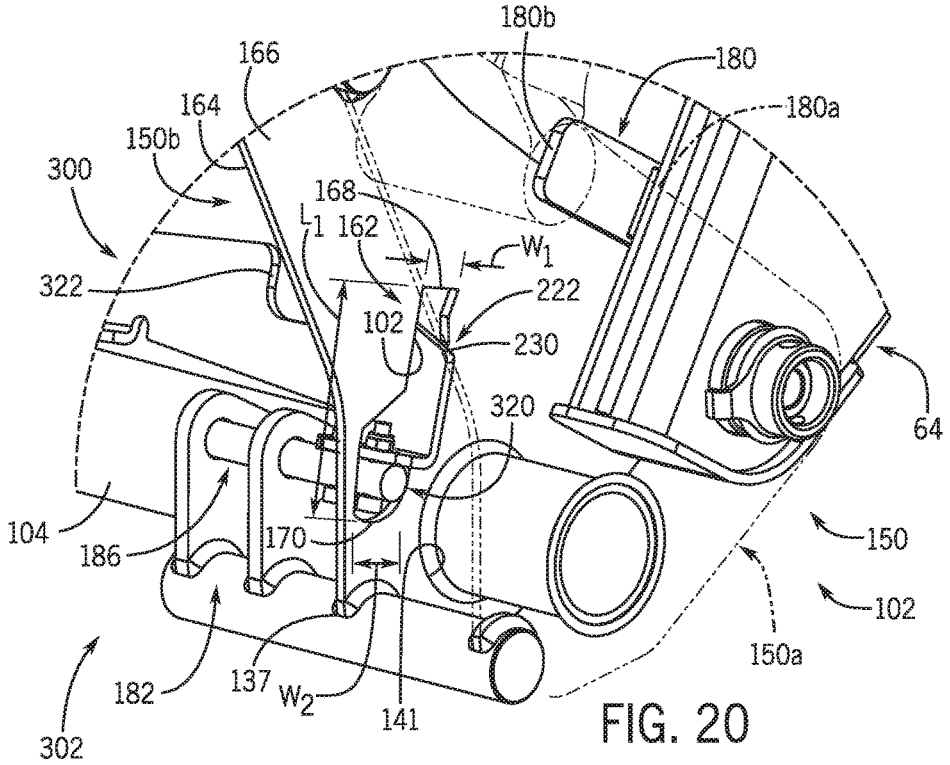
FIG. 20 is a detail perspective view of a second end of the latching carrier of FIG. 18, in which the trigger plate is coupled to the loader arm of the loader, the exterior bracket of the second coupler of the latching carrier is in phantom and the latching carrier is in the first, latched position.

With the latch system 300 in the second, unlatched position, the bucket 52 may be coupled to the loader 10 using the same method described with regard to FIGS. 10-17. Briefly, the loader 10 is advanced toward the bucket 52 and the loader arms 62, 64 are moved, via actuation of the hydraulic cylinders 36, 38 (FIG. 1) to couple or hook the hook 80 of the bucket 52 onto the hook retaining pin 122 of the couplers 100, 102. With the hooks 80 coupled to the latching carrier 302, the loader arms 62, 64 are retracted, via actuation of the hydraulic cylinders 36, 38 (FIG. 1), to roll back the bucket 52 and move the bucket 52 closer to the latching carrier 302. With reference to FIG. 21, the loader arms 62, 64 (FIG. 1) are retracted, via a retraction of the hydraulic cylinders 36, 38 (FIG. 1), which causes the trigger plate 180 to contact a surface 222*a* of the latch plate retaining flange 222. The bucket 52 is continued to be rolled back toward the loader arms 62, 64, via a further retraction of the hydraulic cylinders 36, 38 (FIG. 1), and the contact between the trigger plate 180 and the surface 222*a* of the latch plate retaining flange 222 causes the trigger plate 180 to rotate the latch plate 304 during the roll back until the first wall 226 is no longer in contact with the second surface 166 and the latch plate 304 is aligned with the latch slot 162. Once the latch plate 304 passes through the latch slot 162, the spring 146 pulls the latch plate 304, and the latch system 300 into the first, latched position such that the lock pins 186 are received in the latch receptacles 182 and engage each of the pin receiving flange 82 of the bucket 52 to securely couple the bucket 52 to the loader 10 as shown in FIGS. 18 and 20.

In order to uncouple the bucket 52 from the loader 10, with reference to FIG. 19, the operator manipulates the handle 306 and applies the force F to overcome the spring force Fs to secure the first wall 226 of the latch plate retaining flange 222 against the second surface 166 of the interior bracket 150*b*. As discussed, the contact between the latch plate retaining flange 222 and the second surface 166 of the interior bracket 150*b* retains the latch system 300 in the second, unlatched position.

Also, the following examples are provided, which are numbered for easier reference:

A carrier for coupling loader arms to an implement of a work vehicle, the carrier comprising: a pair of brackets coupled by a cross-rod, each bracket including an inner wall spaced apart from an outer part, at least one of the inner walls defining a latch slot; and a latch mechanism movable between latched and unlatched positions, the latch mechanism including: a latch plate having a retaining flange with an engagement surface; a pair of lock pins coupled to ends of the latch plate; and a pair of latch receptacles associated with the brackets and configured to receive the lock pins, wherein, when in the latched position, the latch mechanism has the lock pins received in the latch receptacles and the engagement surface of the retaining flange disengaged from the one of the inner walls of the brackets, and, when in the unlatched position, the latch mechanism has the retaining flange of the latch plate passed through the latch slot and the engagement surface of the retaining flange engaged with the one of the inner walls of the brackets.

2. The carrier of example 1, wherein the pair of lock pins is coupled to the ends of the latch plate so as to extend along an axis that is offset from a longitudinal axis of the latch plate.

3. The carrier of example 1, wherein the pair of brackets further comprises a pair of first brackets and a pair of second brackets, and the pair of first brackets are coupled to the pair of second brackets by the cross-rod.

4. The carrier of example 3, wherein the pair of second brackets includes an interior second bracket spaced apart from an exterior second bracket, and the interior second bracket defines the latch slot and includes the one of the inner walls that faces the exterior second bracket.

5. The carrier of example 1, further comprising a biasing member coupled to one of the ends of the latch plate that biases the latch mechanism in the latched position.

6. The carrier of example 5, wherein the retaining flange is defined at one of the ends of the latch plate so as to be opposite the biasing member.

7. The carrier of example 1, further comprising a graspable portion coupled to the latch plate between the ends of the latch plate.

8. A work vehicle including a pair of loader arms configured to be coupled to an implement, the work vehicle comprising: a trigger plate coupled to one of the pair of loader arms and the carrier of example 1. The trigger plate contacts the retaining flange to move the latch mechanism from the unlatched position to the latched position.

9. The work vehicle of example 8, wherein the spring is an extension spring.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A carrier for coupling loader arms to an implement of a work vehicle, the carrier comprising:

a pair of brackets coupled by a cross-rod, each bracket including an inner wall spaced apart from an outer part, at least one of the inner walls defining a latch slot; and a latch mechanism movable between latched and unlatched positions, the latch mechanism including:

a latch plate having a retaining flange with an engagement surface;

a pair of lock pins coupled to ends of the latch plate; and a pair of latch receptacles associated with the brackets and configured to receive the lock pins, wherein, when in the latched position, the latch mechanism has the lock pins received in the latch receptacles and the engagement surface of the retaining flange moved to disengage from the one of the inner walls of the brackets by contact of the retaining flange with a trigger plate coupled to one of the loader arms, and, when in the unlatched position, the latch mechanism has the retaining flange of the latch plate passed through the latch slot and the engagement surface of the retaining flange moved to engage with the one of the inner walls of the brackets.

2. The carrier of claim 1, wherein the pair of lock pins is coupled to the ends of the latch plate so as to extend along an axis that is offset from a longitudinal axis of the latch plate.

3. The carrier of claim 1, wherein the pair of brackets further comprises a pair of first brackets and a pair of second brackets, and the pair of first brackets are coupled to the pair of second brackets by the cross-rod.

4. The carrier of claim 3, wherein the pair of second brackets includes an interior second bracket spaced apart from an exterior second bracket, and the interior second bracket defines the latch slot and includes the one of the inner walls that faces the exterior second bracket.

5. The carrier of claim 1, further comprising a biasing member coupled to one of the ends of the latch plate that biases the latch mechanism in the latched position.

6. The carrier of claim 5, wherein the retaining flange is defined at one of the ends of the latch plate so as to be opposite the biasing member.

7. The carrier of claim 1, further comprising a graspable portion coupled to the latch plate between the ends of the latch plate.

8. A work vehicle including a pair of loader arms configured to be coupled to an implement, the work vehicle comprising:

a trigger plate coupled to one of the pair of loader arms; and a carrier for coupling the pair of loader arms to the implement, the carrier comprising:

a pair of brackets coupled by a cross-rod, each bracket including an inner wall spaced apart from an outer part, at least one of the inner walls defining a latch slot; and a latch mechanism movable between latched and unlatched positions, the latch mechanism including:

a latch plate having a retaining flange with an engagement surface;

a pair of lock pins coupled to ends of the latch plate; and a pair of latch receptacles associated with the brackets and configured to receive the lock pins, wherein, when in the latched position, the latch mechanism has the lock pins received in the latch receptacles and the engagement surface of the retaining flange moved to disengage from the one of the inner walls of the brackets, and, when in the unlatched position, the latch mechanism has the retaining flange of the latch plate passed through the latch slot and the engagement surface of the retaining flange moved to engage with the one of the inner walls of the brackets; and wherein the trigger plate contacts the retaining flange to move the latch mechanism from the unlatched position to the latched position.

9. The work vehicle of claim 8, further comprising a graspable portion coupled to the latch plate between the ends of the latch plate.

10. The work vehicle of claim 8, wherein the pair of lock pins is coupled to the ends of the latch plate so as to extend along an axis that is offset from a longitudinal axis of the latch plate.

11. The work vehicle of claim 8, wherein the pair of brackets further comprises a pair of first brackets and a pair of second brackets, and the pair of first brackets are coupled to the pair of second brackets by the cross-rod.

12. The work vehicle of claim 11, wherein the pair of second brackets includes an interior second bracket spaced apart from an exterior second bracket, and the interior second bracket defines the latch slot and includes the one of the inner walls that faces the exterior second bracket.

13. The work vehicle of claim 8, further comprising a biasing member coupled to one of the ends of the latch plate that biases the latch mechanism in the latched position.

14. The work vehicle of claim 13, wherein the retaining flange is defined at one of the ends of the latch plate so as to be opposite the biasing member.

15. A work vehicle including a pair of loader arms configured to be coupled to an implement, the work vehicle comprising:

a trigger plate coupled to one of the pair of loader arms; and a carrier for coupling the pair of loader arms to the implement, the carrier comprising:

a pair of brackets coupled by a cross-rod, each bracket including an inner wall spaced apart from an outer part, at least one of the inner walls defining a latch slot; and a latch mechanism movable between latched and unlatched positions, the latch mechanism including:

a latch plate having a retaining flange with an engagement surface;

a pair of lock pins coupled to ends of the latch plate;

a spring coupled to one of the ends of the latch plate, the spring biases the latch mechanism in the latched position; and a pair of latch receptacles associated with the brackets and configured to receive the lock pins, wherein, when in the latched position, the latch mechanism has the lock pins received in the latch receptacles and the engagement surface of the retaining flange moved to disengage from the one of the inner walls of the brackets, and, when in the unlatched position, the latch mechanism has the retaining flange of the latch plate passed through the latch slot and the engagement surface of the retaining flange moved to engage with the one of the inner walls of the brackets; and wherein the trigger plate contacts the retaining flange to move the latch mechanism from the unlatched position to the latched position.

16. The work vehicle of claim 15, wherein the pair of lock pins is coupled to the ends of the latch plate so as to extend along an axis that is offset from a longitudinal axis of the latch plate.

17. The work vehicle of claim 15, wherein the pair of brackets further comprises a pair of first brackets and a pair of second brackets, the pair of first brackets are coupled to the pair of second brackets by the cross-rod, the pair of second brackets includes an interior second bracket spaced apart from an exterior second bracket, and the interior second bracket defines the latch slot and includes the one of the inner walls that faces the exterior second bracket.

18. The work vehicle of claim 15, wherein the spring is an extension spring.

19. The work vehicle of claim 18, wherein the retaining flange is defined at one of the ends of the latch plate so as to be opposite the spring.

* * * * *